US005913366A

United States Patent [19]

Williams et al.

[11] Patent Number: 5,913,366

[45] **Date of Patent: *Jun. 22, 1999**

[54] METHODS FOR EXTINGUISHING TANK FIRES, INCLUDING LOW BOILING POINT AND/OR LOW AUTO-IGNITION FLUID FIRES

[75] Inventors: Dwight P. Williams, Vidor; Eric Lavergne, Groves, both of Tex.

[73] Assignee: Williams Fire & Hazard Control, Inc., Vidor, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/735,213

[22] Filed: Oct. 21, 1996

Related U.S. Application Data

[63] Continuation-in-part of application No. 08/685,701, Jul. 24, 1996, Pat. No. 5,829,533, which is a continuation-in-part of application No. 08/427,360, Apr. 24, 1995, Pat. No. 5,566,766.

[51] Int. Cl.[6] ..... A62C 3/06

[52] U.S. Cl. ..... 169/46; 169/66; 169/68

[58] Field of Search ..... 169/46, 47, 66, 169/67, 68

[56] References Cited

U.S. PATENT DOCUMENTS

| | | | |
|---|---|---|---|
| 1,775,846 | 9/1930 | Blaw | 169/67 |
| 4,781,252 | 11/1988 | Wilburn et al. | 169/66 |
| 5,240,078 | 8/1993 | Worthington | 169/67 |
| 5,566,766 | 10/1996 | Williams | 169/43 |

FOREIGN PATENT DOCUMENTS

| | | | |
|---|---|---|---|
| 1400621 | 6/1988 | U.S.S.R. | 169/66 |
| 1416129 | 8/1988 | U.S.S.R. | 169/46 |

*Primary Examiner*—Gary C. Hoge
*Attorney, Agent, or Firm*—Butler & Binion, L.L.P.; Sue Z. Shaper

[57] ABSTRACT

Improved methods for extinguishing tank fires, in particular of low boiling point and/or low auto ignition point fluids, the improved methods including cooling inner and outer tank wall portions and improving a foam attack from staged nozzles through creating side foot prints at the site and correcting footprint range, footprint length, footprint width or foam run for variations in factors such as wind conditions, nozzle stream width, head pressure, percent of foam concentrate, the burning fluid, the type of foam and the temperature of the burning fluid.

24 Claims, 16 Drawing Sheets

SQ. FT. = 39,741
APPLICATION DENSITY RATE = .18
MINIMUM APPLICATION = 7,153 GPM
FLOW = 7,000 GPM

SQ. FT. = 39,741
APPLICATION DENSITY RATE = .15
MINIMUM APPLICATION = 5,961 GPM
FLOW = 6,000 GPM

SQ. FT. = 59,366
APPLICATION DENSITY RATE = .202 (ACTUAL)
MINIMUM APPLICATION = 11,992 GPM
FLOW = 12,000 GPM

SQ. FT. = 51,045
APPLICATION DENSITY RATE = .235
MINIMUM APPLICATION = 11,996 GPM
FLOW = 12,000 GPM

SQ. FT. = 75,926
APPLICATION DENSITY RATE = .21
MINIMUM APPLICATION = 15,944 GPM
FLOW = 16,000 GPM

SQ. FT. = 75,926
APPLICATION DENSITY RATE = .24
MINIMUM APPLICATION = 18,222 GPM
FLOW = 18,000 GPM

SQ. FT. = 93,435
APPLICATION DENSITY RATE = .21
MINIMUM APPLICATION = 19,621 GPM
FLOW = 20,000 GPM

SQ. FT. = 82,916
APPLICATION DENSITY RATE = .24
MINIMUM APPLICATION = 19,900 GPM
FLOW = 20,000 GPM

SQ. FT. = 93,435
APPLICATION DENSITY RATE = .256
MINIMUM APPLICATION = 23,920 GPM
FLOW = 24,000 GPM

SQ. FT. = 93,435
APPLICATION DENSITY RATE = .3
MINIMUM APPLICATION = 28,031 GPM
FLOW = 28,000 GPM

FIG. 3A
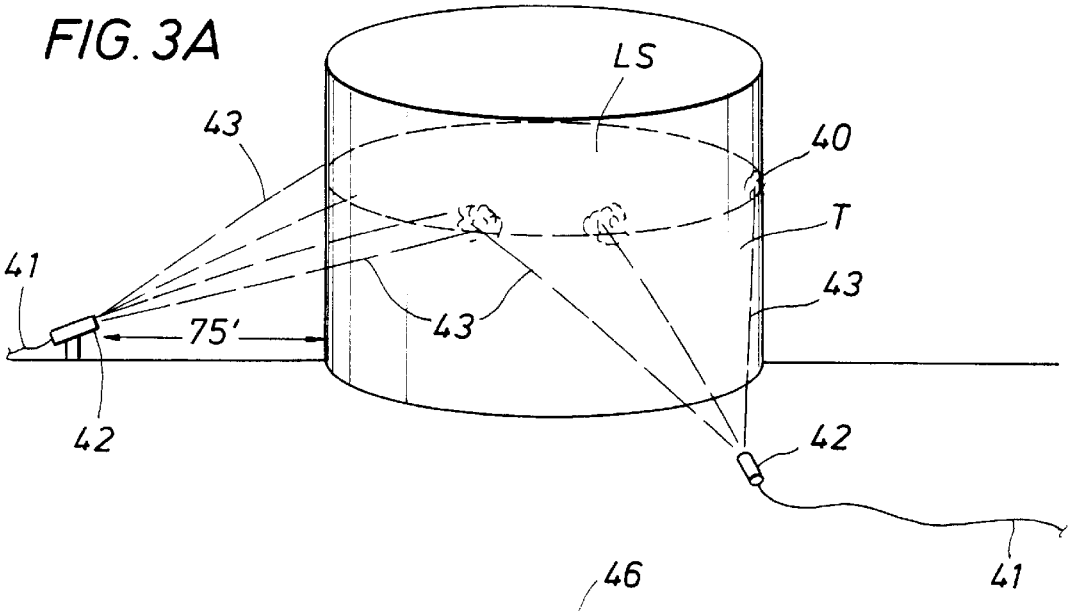
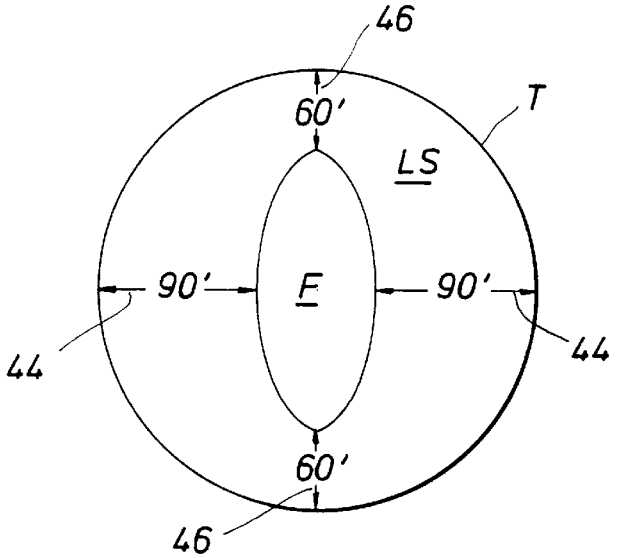
FIG. 3B
FIG. 3C
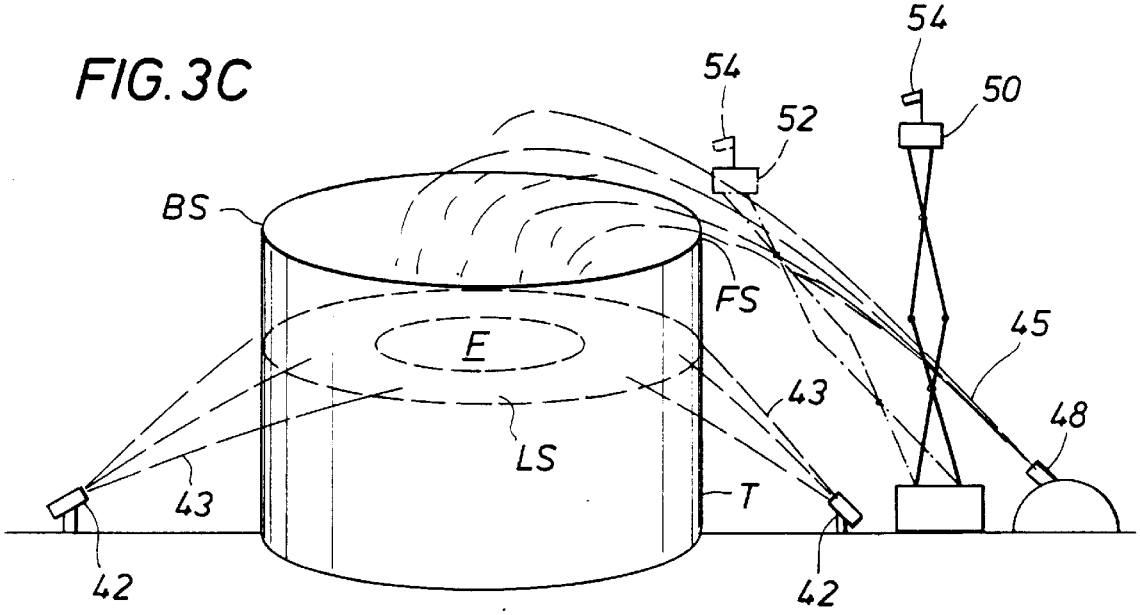

METHODS FOR EXTINGUISHING TANK FIRES, INCLUDING LOW BOILING POINT AND/OR LOW AUTO-IGNITION FLUID FIRES

This application is a continuation-in-part of Ser. No. 08/685,701, filed Jul. 24, 1996, now U.S. Pat. No. 5,829,533, which is a continuation-in-part of Ser. No. 08/427,360, filed Apr. 24, 1995, now U.S. Pat. No. 5,566,766. The specifications of both prior pending applications are herein incorporated by reference.

FIELD OF INVENTION

This invention relates to improved methods for extinguishing tank fires, including tank fires involving fluids having low boiling points and/or low auto-ignition points.

BACKGROUND OF THE INVENTION

In specific parts of the country, primarily urban areas where concentrations of ozone in the summer or carbon monoxide in the winter exceed established air-quality standards, the Clean Air Act Amendments of 1990 mandate compounds that add oxygen (referred to as oxygenates) be added either seasonally or year round to gasoline. Such oxygenates increase the octane of the gasoline and improve air quality.

Even though oxygenates are mandated primarily in urban areas, it is estimated that oxygenates are added to more than 30 percent of the gasoline sold in the United States presently. By the end of this decade, the Oxygenated Fuels Association estimates that oxygenates will be added to 70 percent of the gasoline sold in this country.

Methyl tertiary butyl ether (MTBE) comprises one popular oxygenate permitted in unleaded gasoline up to a level of 15 percent. MTBE is a volatile organic compound (VOC) made from methanol and derived from natural gas. As one of the primary ingredients in reformulated gasolines, production of MTBE in 1993 ranked second among all organic chemicals manufactured. In 1993, 24 billion pounds of MTBE, worth about $3 billion, were produced. MTBE is commonly used because of its low cost, ease of production, and favorable transfer and blending characteristics.

Although MTBE comprises a popular, cost effective clean-burning oxygenate, with high octane and "relatively low" volatility, the U.S. Environmental Protection Agency (EPA) has tentatively classified the substance as a possible human carcinogen. Hence, other oxygenates, such as TAME (tertiary amyl methyl ether) are receiving serious development and consideration. Ethanol and ETBE (ethyl tertiary butyl ether) may compete for the consumer market. Environmental, health, economic and even political factors will probably affect the success and market share of competing products in this area of "finished product" hydrocarbons, gas additives and/or blended fuels.

As of this date, MTBE is representative of a growing inventory of "finished product" fluids that are manufactured in such quantities as to require storage in large tanks and that have either a relatively low boiling point (as compared to gasoline or crude, for instance) or a low auto-ignition temperature, or possibly both. The boiling point of MTBE is approximately 133° F. MTBE's auto-ignition temperature is approximately 450° F. The auto-ignition temperature of gasoline, by comparison, is approximately 900° F.

The increased production of and need for "finished product" hydrocarbons—blended fuels, MTBE, TAME and the like—increases the danger and risks of handling fires involving such fluids. Produced and consumed in large volumes, the fluids must be stored in large tanks. The present inventors have discovered that existing systems for extinguishing hydrocarbon tank fires, including systems for the management of foam attack, should be improved to cover the difficult and dangerous situations that could arise with MTBE and the like tank fires.

The present invention discloses improved fire fighting systems with steps that are beneficial when addressing fires of low boiling point and/or a low auto-ignition point fluids. The invention includes steps for improving foam attack techniques. The present invention also teaches incorporating improved steps and improved foam attacks into systems using nozzles stored on or around a tank rim as well as distant from the tank.

SUMMARY OF THE INVENTION

A fire fighting technique is disclosed for industrial scale tanks that combines a foam attack with a cooling attack on inner and outer tank wall portions. The cooling attack is directed preferably at a level that is approximately that of the height of the residual fluids in the tank. The cooling attack is preferably conducted subsequent to establishing the foam blanket. Such a system proposes to minimize fire extinguishing time and to conserve foam, costs and human resources.

Preferably, portions of the outer tank wall would be cooled with water while portions of the inner tank wall would be cooled with foam. The nozzles for cooling tank wall portions may, in some cases, be the same as the master stream nozzles used to perform the foam attack. Alternately, such nozzles may be additional nozzles staged a distance from the tank. Nozzles located on the rim of the tank might also be used, either permanent nozzles or temporarily placed nozzles such as a wand nozzle. Aerial nozzles positioned above the wall of the tank might also be advantageously used. Preferably, one or two aerial nozzles would have the capacity to throw dry chemicals.

The foam attack to establish the foam blanket could be accomplished through bubbling foam up through the tank or through discharging foam down the inside walls of the tank, as well as by staged nozzles distant from the tank. The choice is largely dictated by the circumstances.

One aspect of the invention, for foam attacks that include empirically determining a footprint for a nozzle and configuring one or more nozzles such that predicted footprint and predicted foam run cover a tank fluid surface, includes creating a footprint of foam outside of the tank with a nozzle to be utilized in extinguishing the fire. Aspects of the foam footprint, such as range, footprint length and footprint width, can be noted and advantageously used to more precisely configure the nozzle or nozzles to achieve an effective and efficient foam blanket.

In another aspect of the invention, also including a foam attack that empirically determines a footprint for a nozzle and configures one or more nozzles such that predicted footprint and predicted foam run cover a tank fluid surface, at least one of predicted footprint or predicted foam run is adjusted to take into account at least one further factor. These further factors may include the selected nozzle stream width the selected and percent of foam concentrate, as well as actual wind conditions, actual head pressure, actual burning fluid, actual type of foam being utilized and the estimated temperature of the burning fluid. Some variations in footprint range, footprint width, footprint length and foam run can be precalculated based upon a variation in the above factors. In particular, variations in footprint range can be precalculated based on variations in water head pressure. Variations in foam run can be precalculated based on variations in foam type, percent concentration of foam and type of fluid burning.

BRIEF DESCRIPTION OF THE DRAWINGS

A better understanding of the present invention can be obtained from the detailed description of exemplary embodiments set forth below, to be considered in conjunction with the attached drawings, in which:

FIG. 3A illustrates tank wall cooling for an outer tank wall surface.

FIG. 3B illustrates a foam attack wherein a foam blanket is achieved using a footprint plus predicted foam run.

FIG. 3C illustrates outer tank wall rim cooling as well as the utilization of a staged nozzle over the edge of the tank that might preferably provide dry powder capability.

DETAILED DESCRIPTION OF PREFERRED EMBODIMENTS

MTBE, as well as other "finished product" fluids and blended fuels, is stored in large tanks. Specifically, such tanks may have a height of 50 feet to 75 feet and a diameter of from 100 feet to several hundred feet. In the case of a fire in an MTBE tank, it has been discovered that it is relatively straightforward to achieve a "knock down" of the flames. However, vagrant ghost flames reappear across the surface of even an established foam blanket, and persist for quite a period of time after knockdown. ("Knock down" signals the extinguishment of the majority of the flame.) Particularly with MTBE (and it is anticipated to be true with other similar fluids, such as finished product fluids having a relatively low boiling point and/or a low auto-ignition temperature), such flames may persist after knock down for several hours, usually adjacent to and dancing from the inner walls of the tank.

Treating and containing these vagrant flames exhausts foam and other resources and significantly increases the expense of extinguishing the fire. Residual vagrant flames from an MTBE fire may persist for as long as three hours after knock down. During such time a full foam blanket must be maintained. The possibility of lessening that considerable expense heightens the value of the system of the present invention, which teaches a cooling attack on portions of the tank walls, and in particular, inner portions of the tank walls.

Absent the new technique, a foam blanket must be maintained until the mass of the tank cools essentially below the boiling point of the fluid. Up to that point a fire fighter must guard against boiling fluid wicking at or near the wall, and the fluid behaving somewhat like a flammable gas. The depth of the foam blanket appears of little relevance in these circumstances, until the tank walls can be sufficiently cooled.

Foam attacks can achieve a foam blanket and maintain a foam blanket with a variety of techniques. FIGS. 1A, 1B and FIGS. 2A through 2T illustrate one method of foam attack using nozzles staged distant from the tank.

Figure 1A:
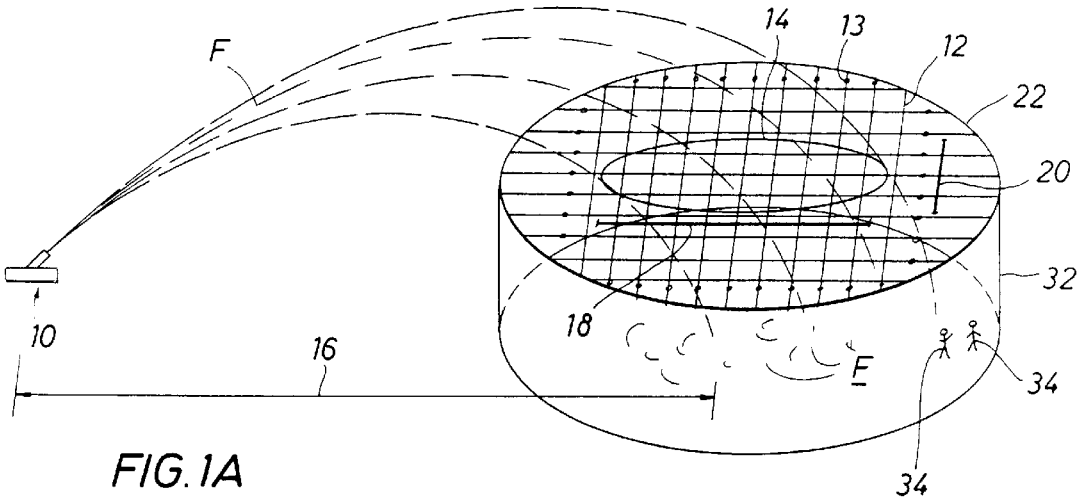
FIG. 1A illustrates an empirical technique for predicting a footprint for a given nozzle and certain nominally selected conditions.
Figure 1B:
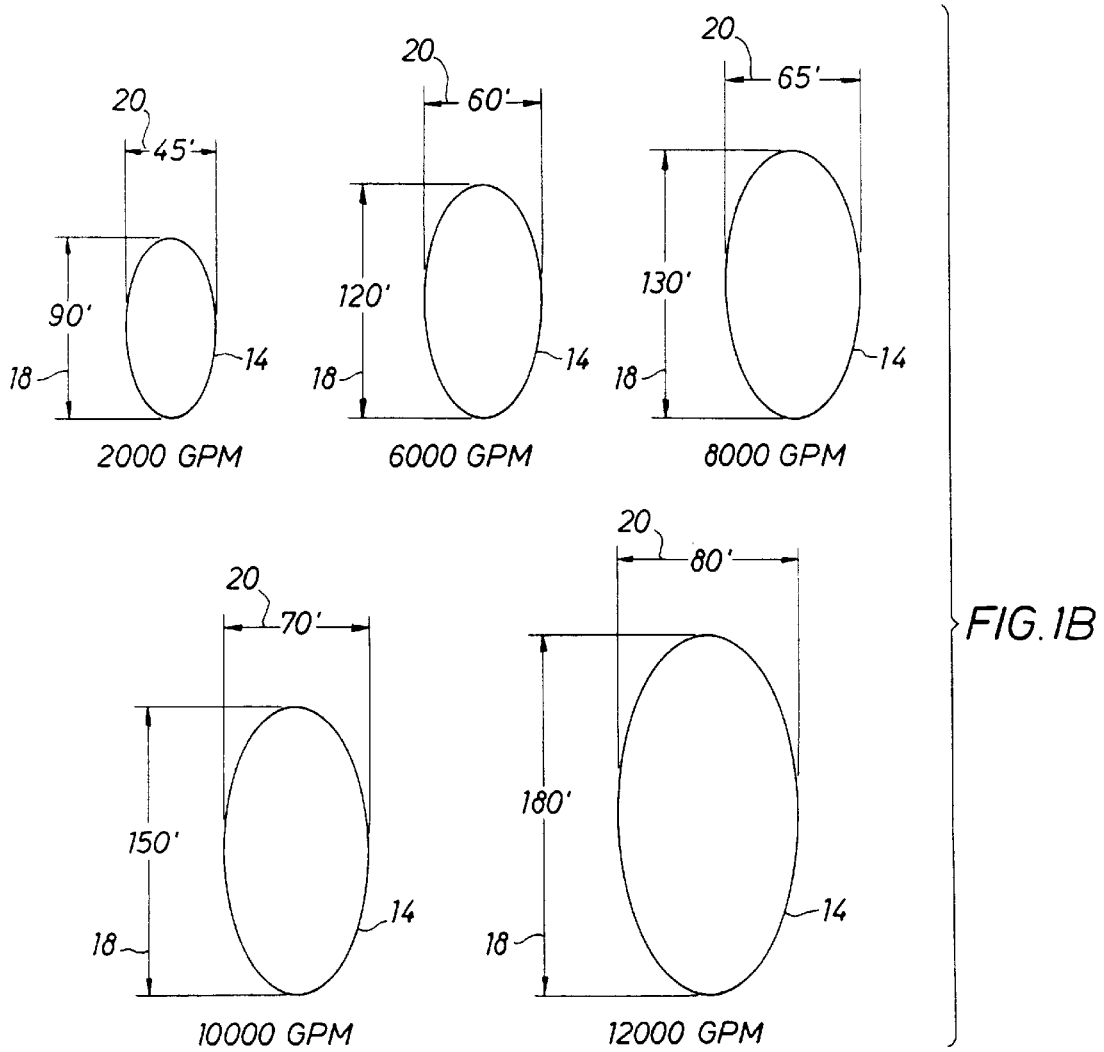
FIG. 1B illustrates a variation in footprint length and footprint width for various sized nozzles, from 2,000 gallons per minute to 12,000 gallons per minute.

FIG. 1A illustrates one process for empirically determining a nozzle footprint. FIG. 1B illustrates a variety of footprints including footprint length and footprint width for a variety of sizes of a particular type of nozzle. This information is typically gathered under a set of nominal conditions such as a nominal 100 psi water pressure, nominal wind conditions of 5 to 10 miles per hour, nominal metering of foam concentrate and an optimal straight stream nozzle pattern.

Figure 2B:
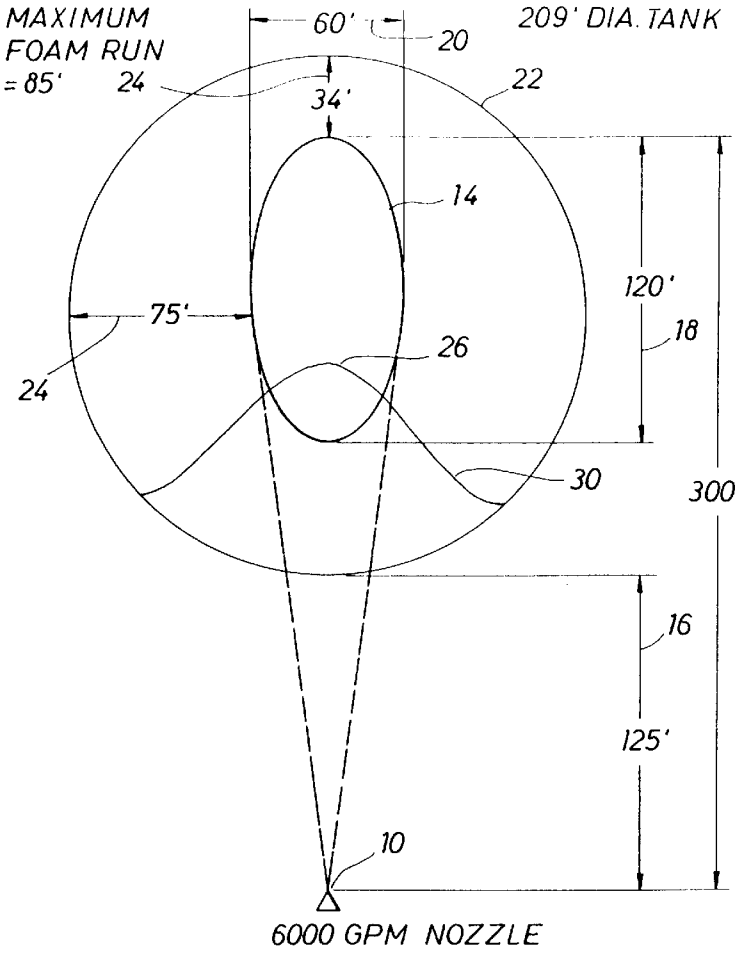
FIGS. 2A–2T illustrate the use of predicted footprints together with predicted foam run to stage one or more nozzles in order to achieve coverage of the liquid surface in a tank with foam.
Figure 2A:
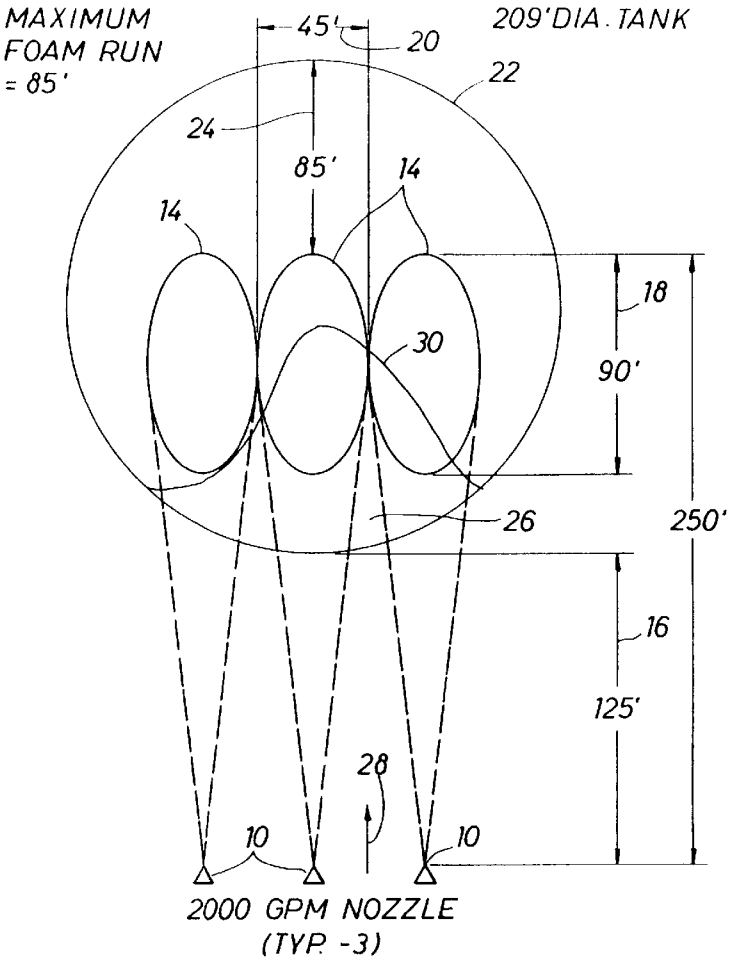
Figure 2D:
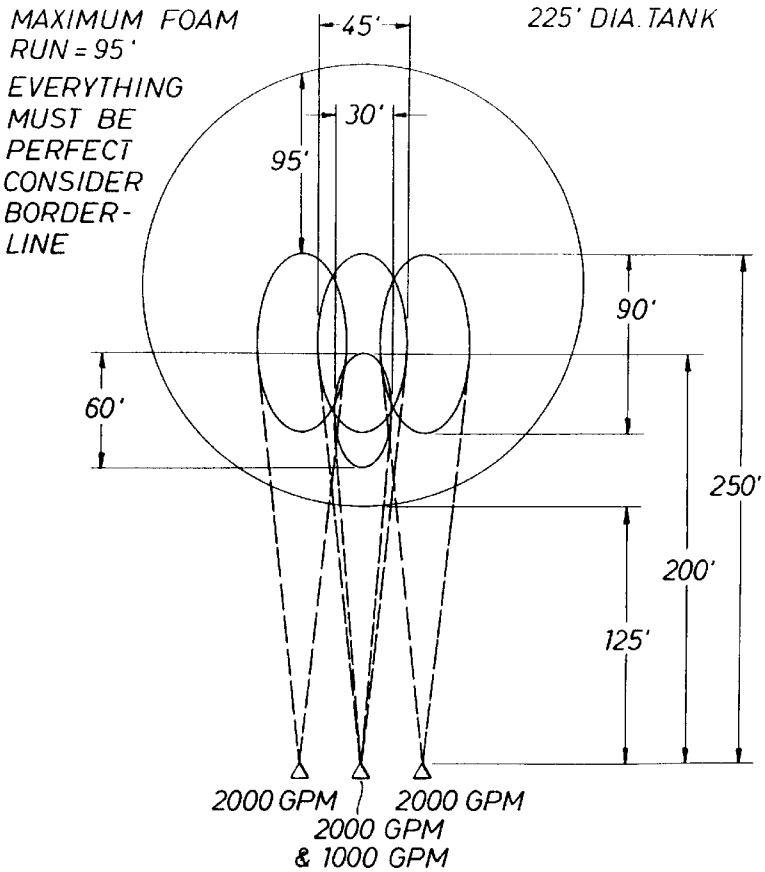
Figure 2C:
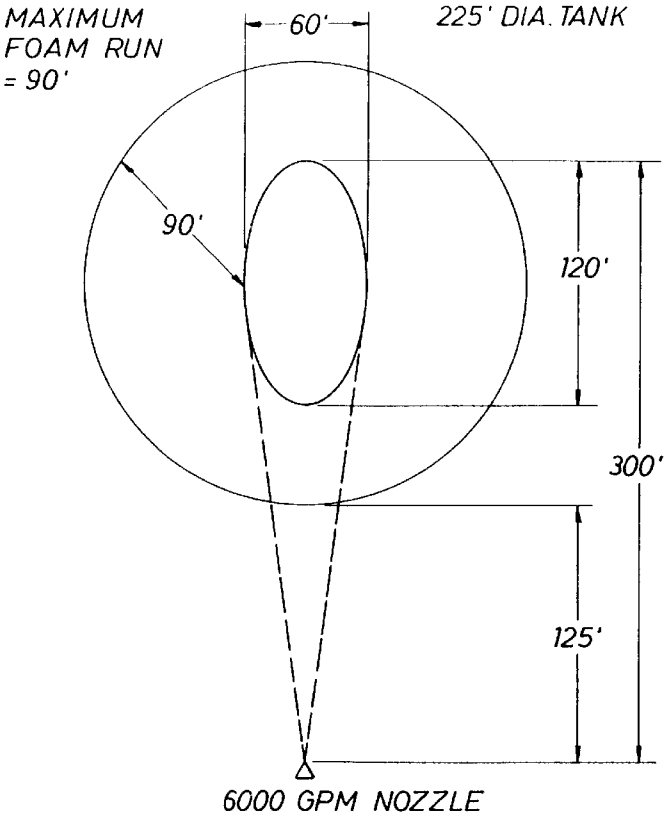
Figure 2F:
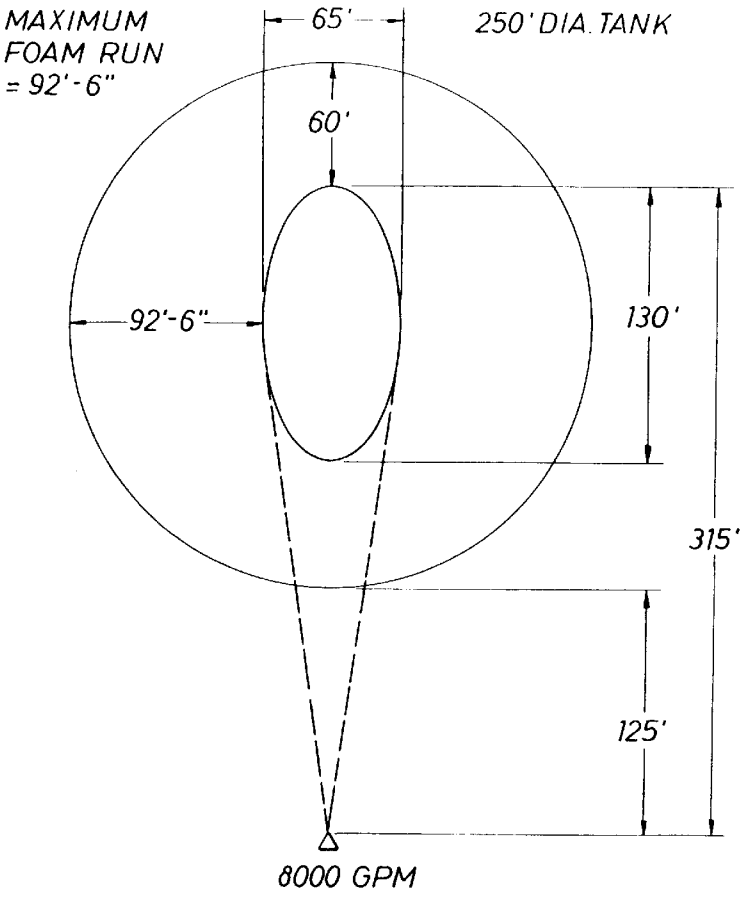
Figure 2E:
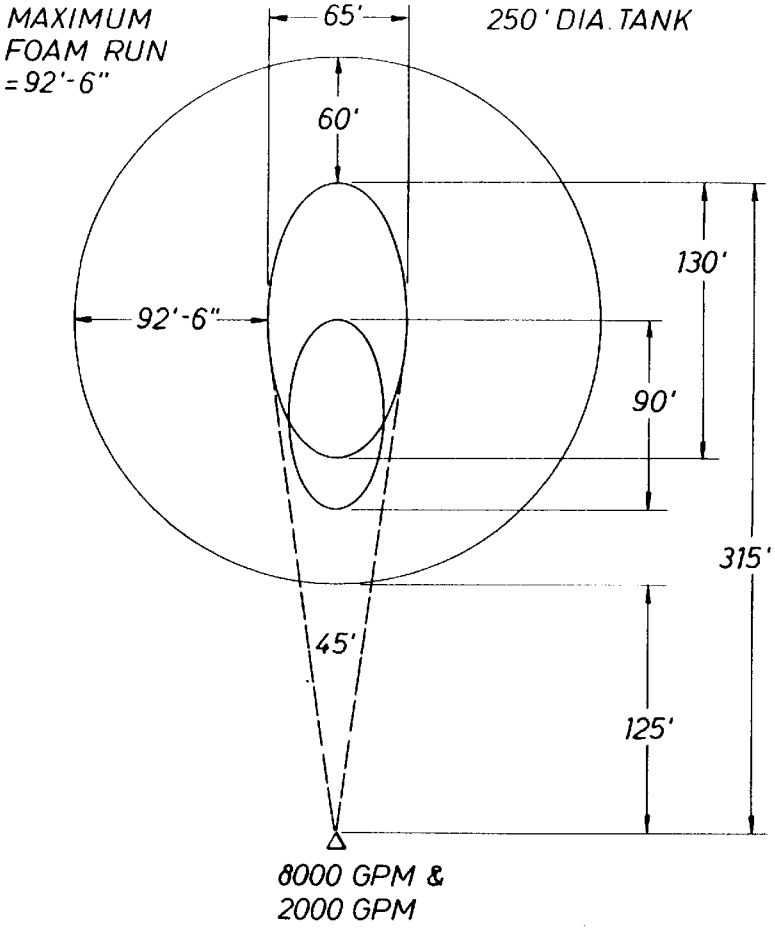
Figure 2H:
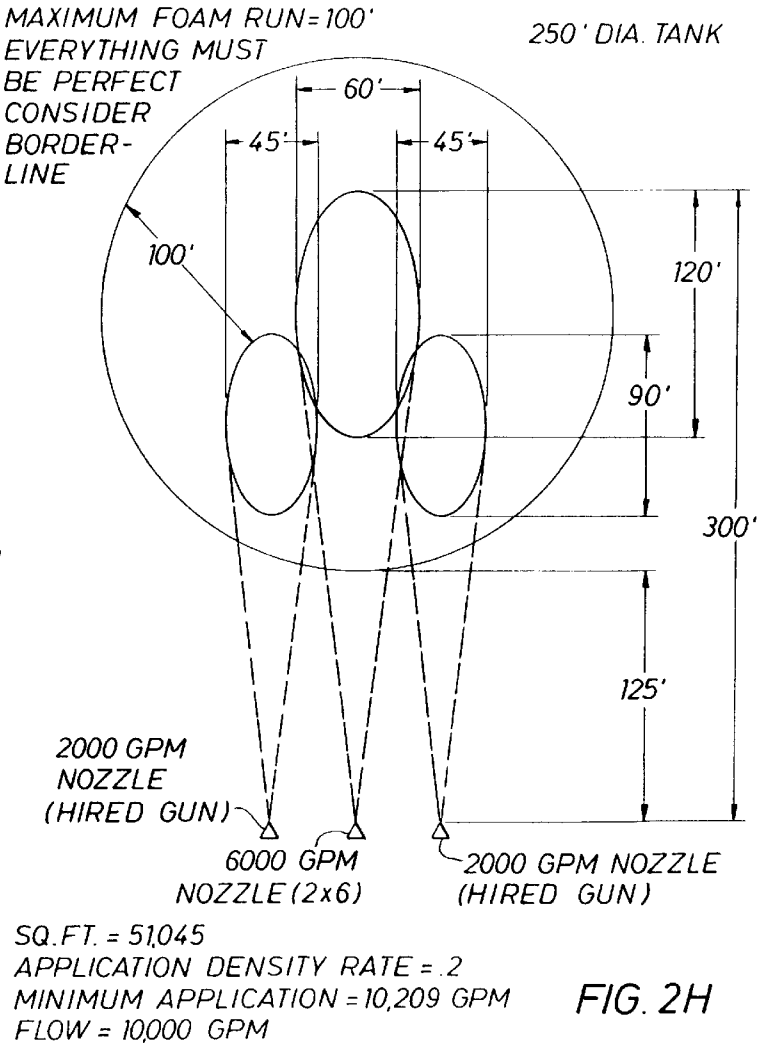
Figure 2G:
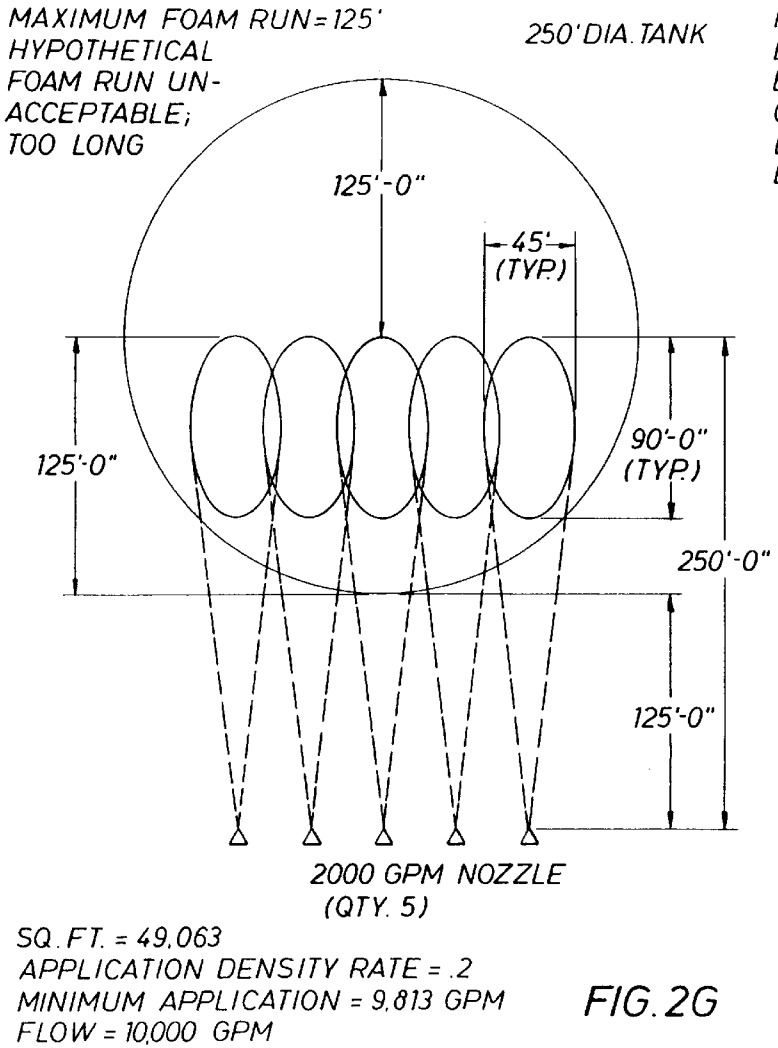
Figure 2J:
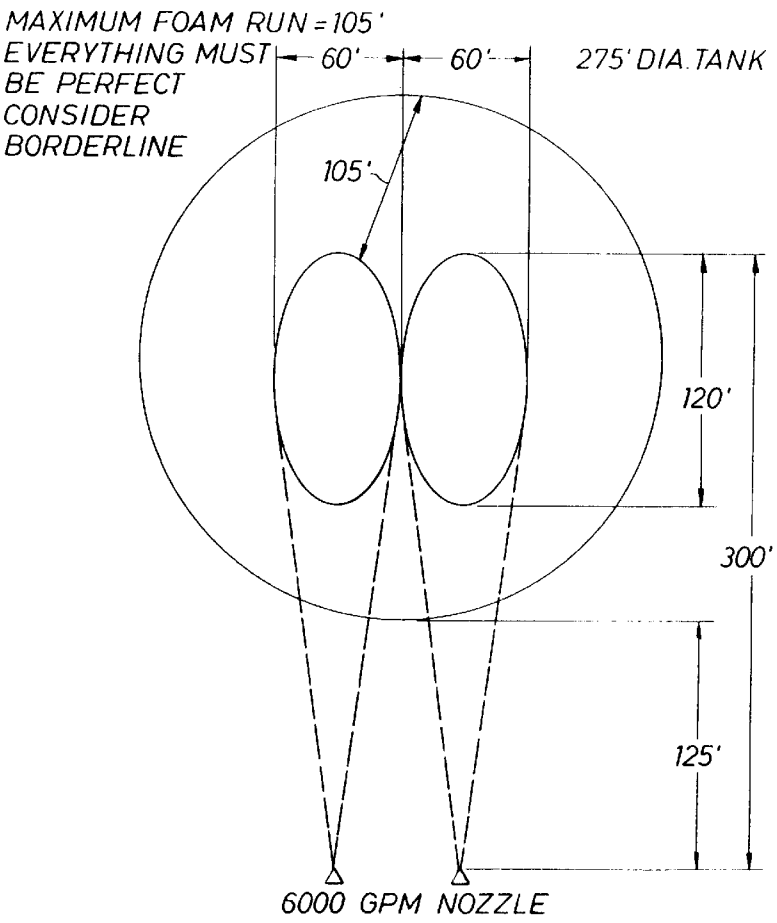
Figure 2I:
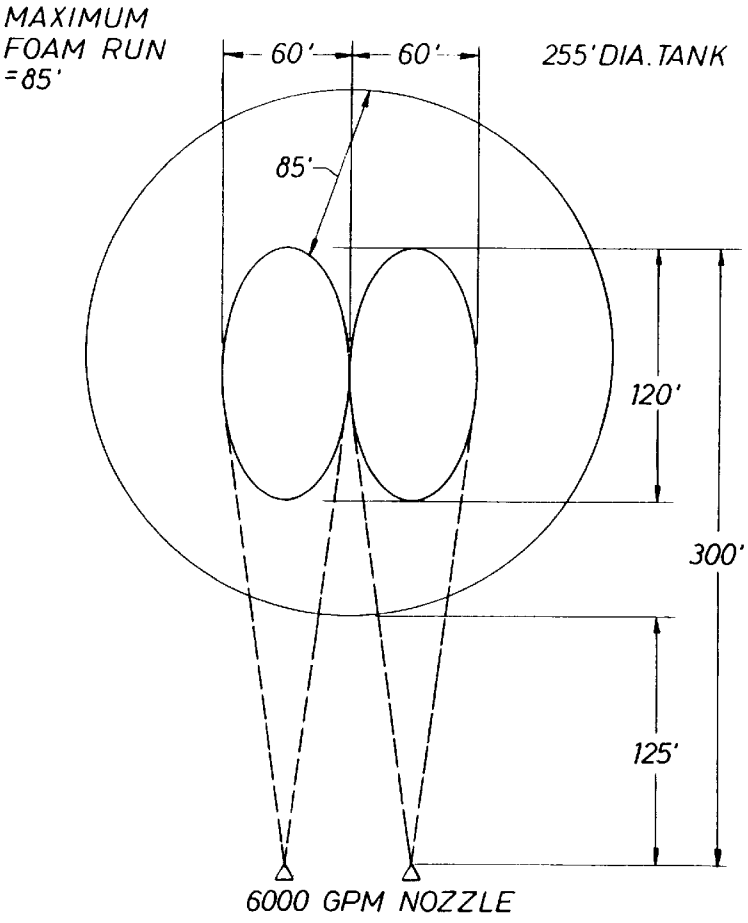
Figure 2L:
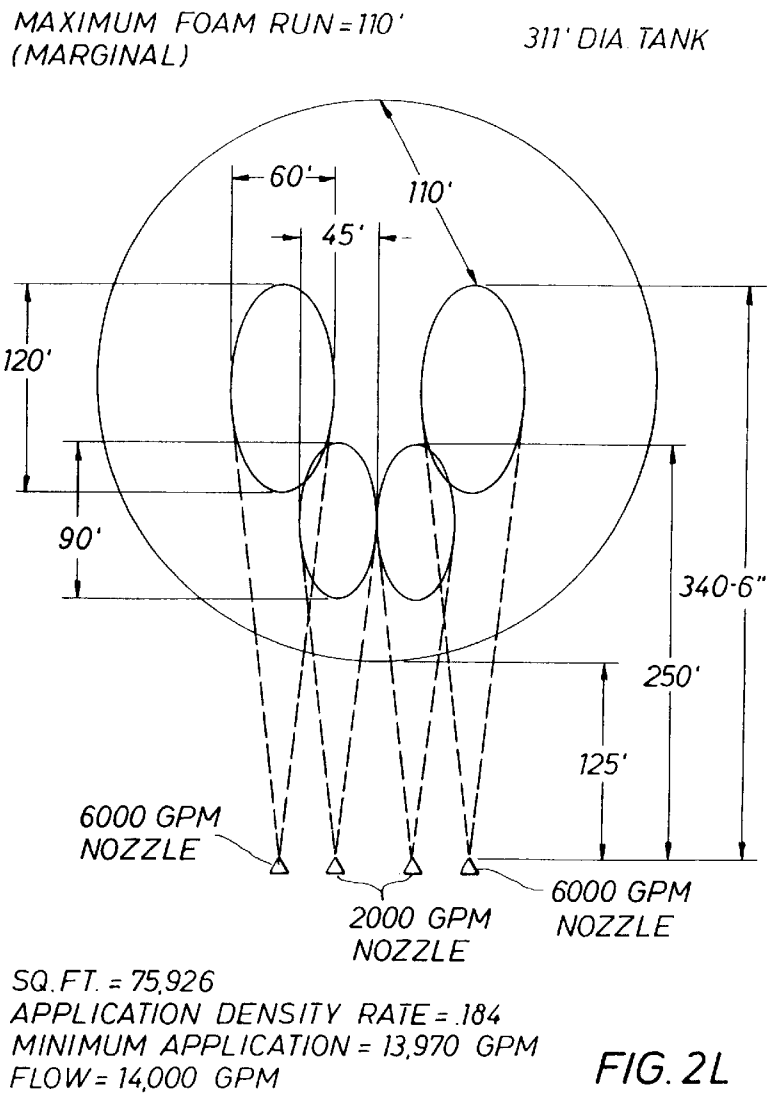
Figure 2K:
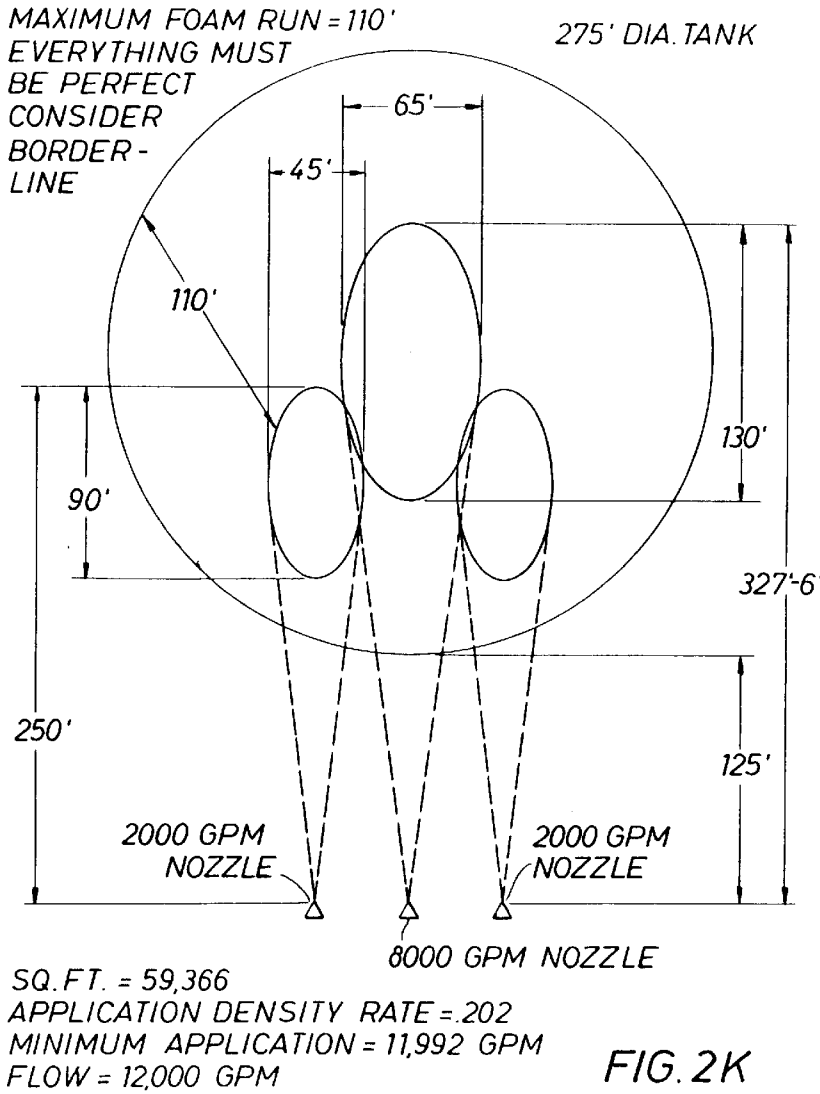
Figure 2N:
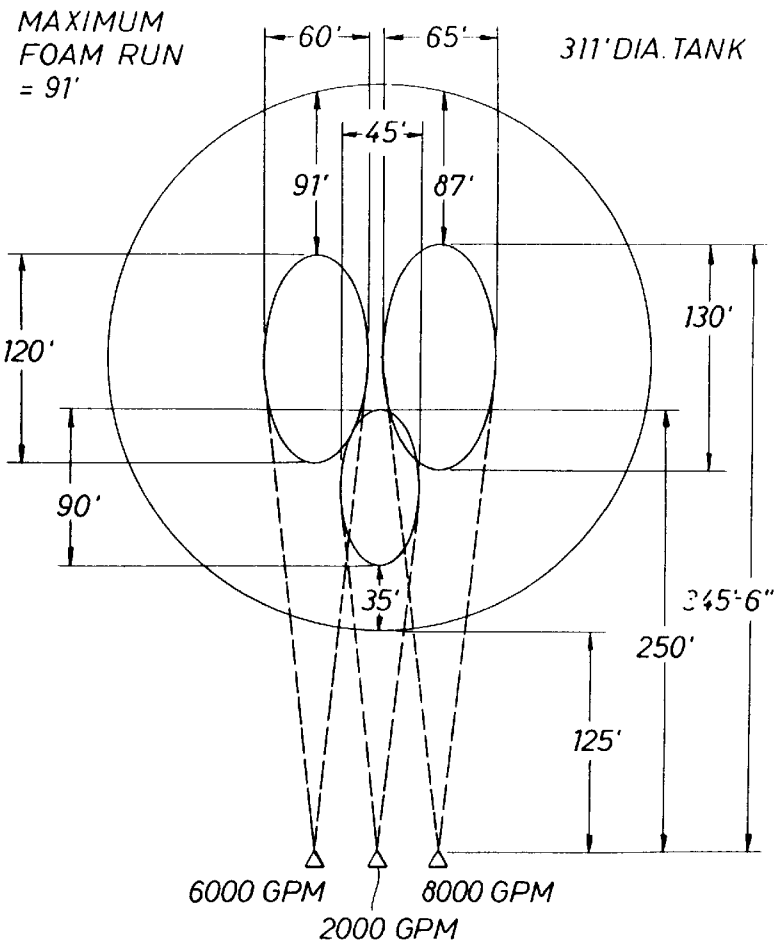
Figure 2M:
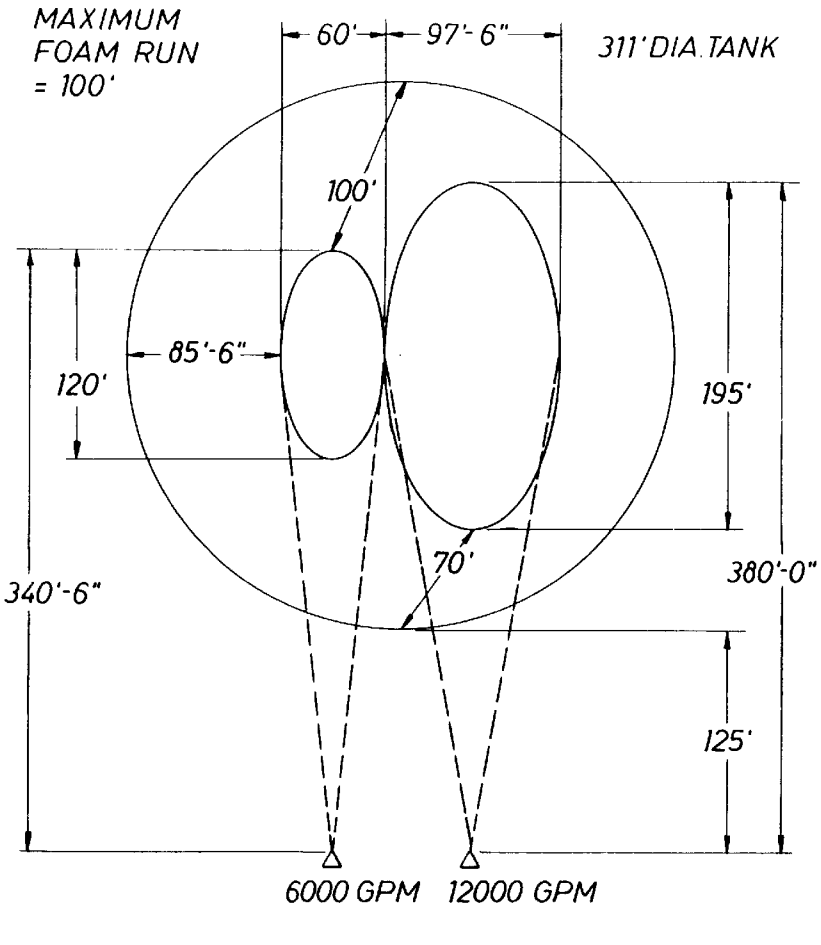
Figure 2P:
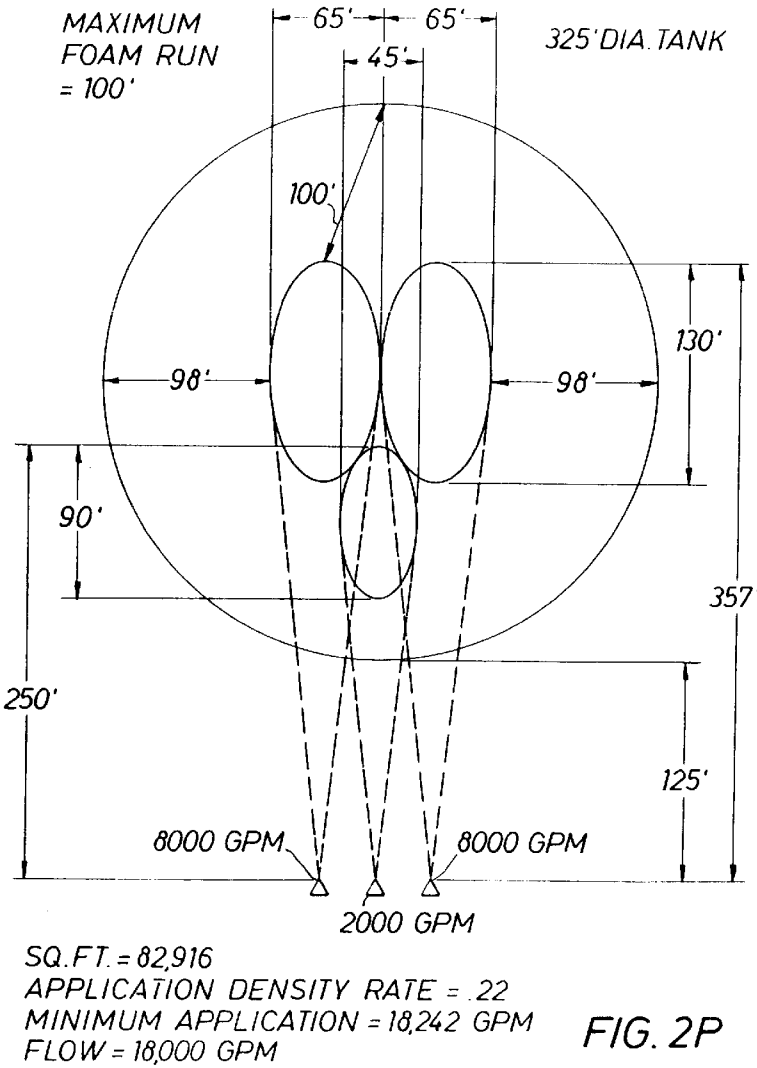
Figure 2O:
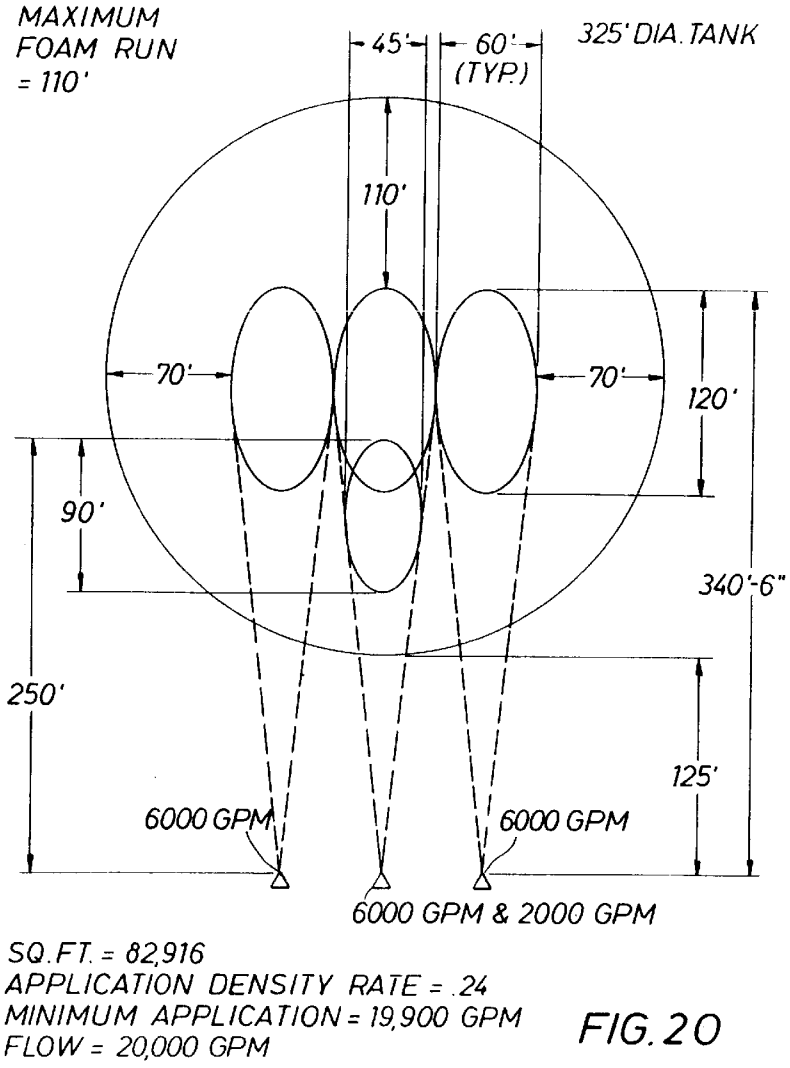
Figure 2R:
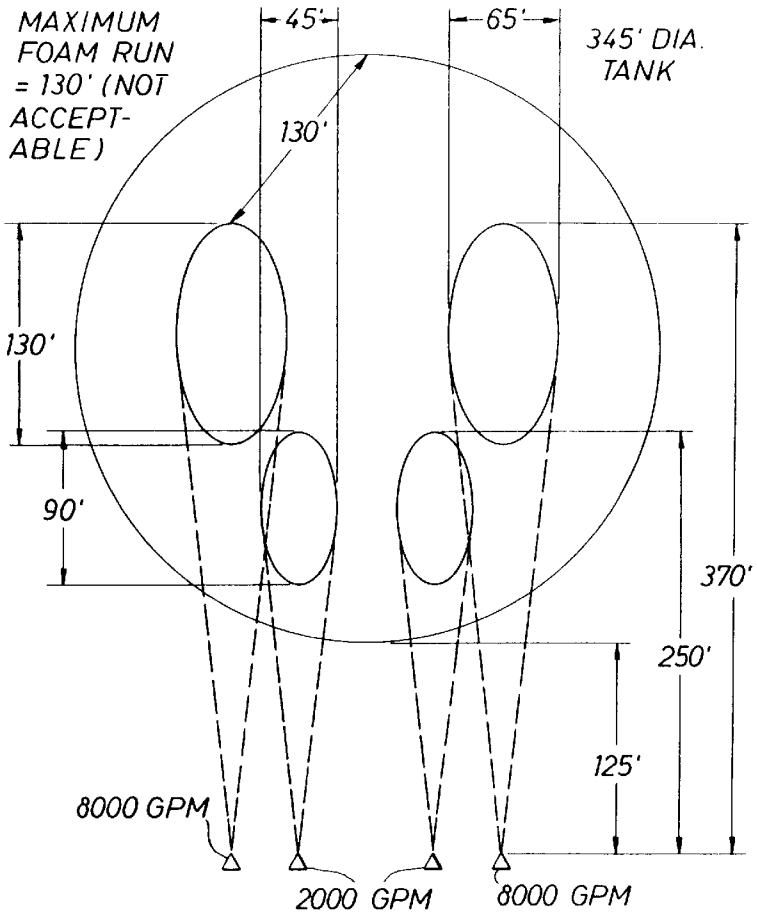
Figure 2Q:
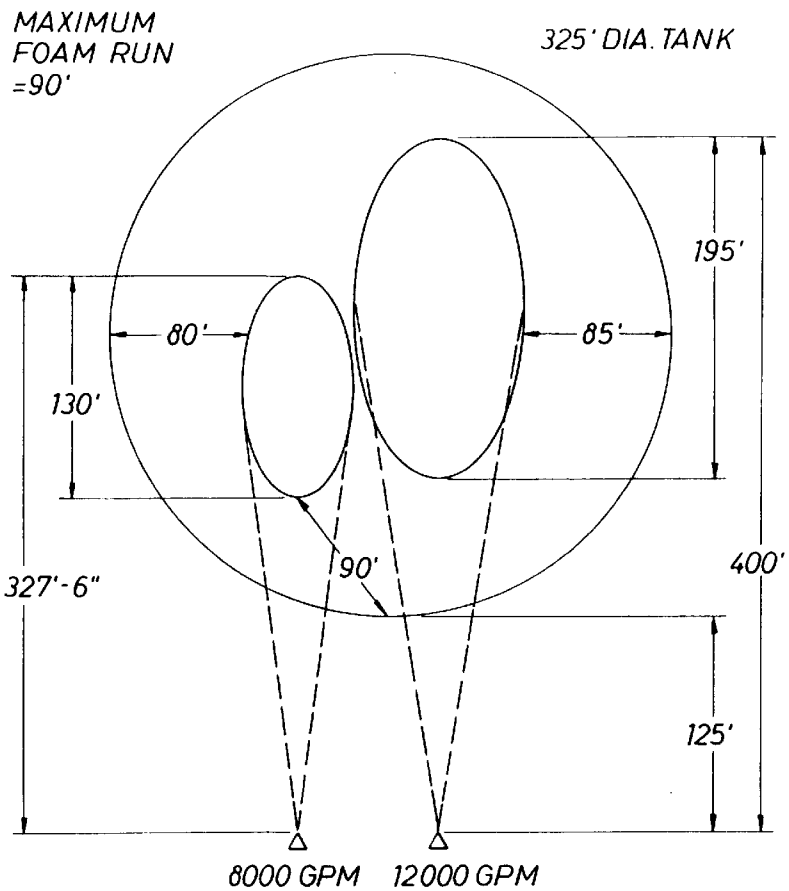
Figure 2T:
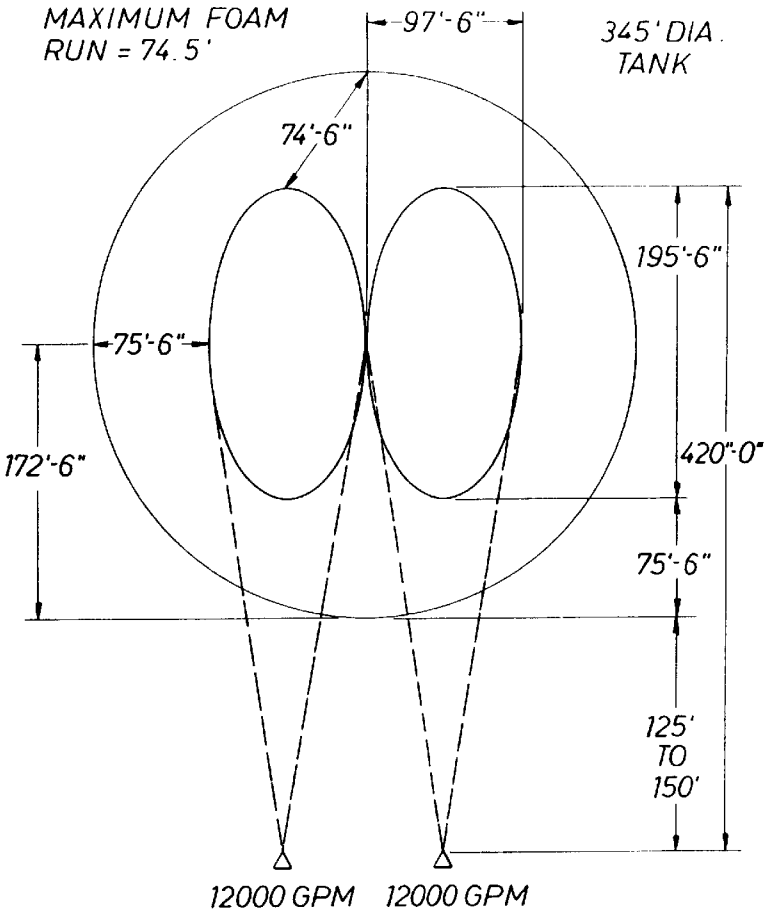
Figure 2S:
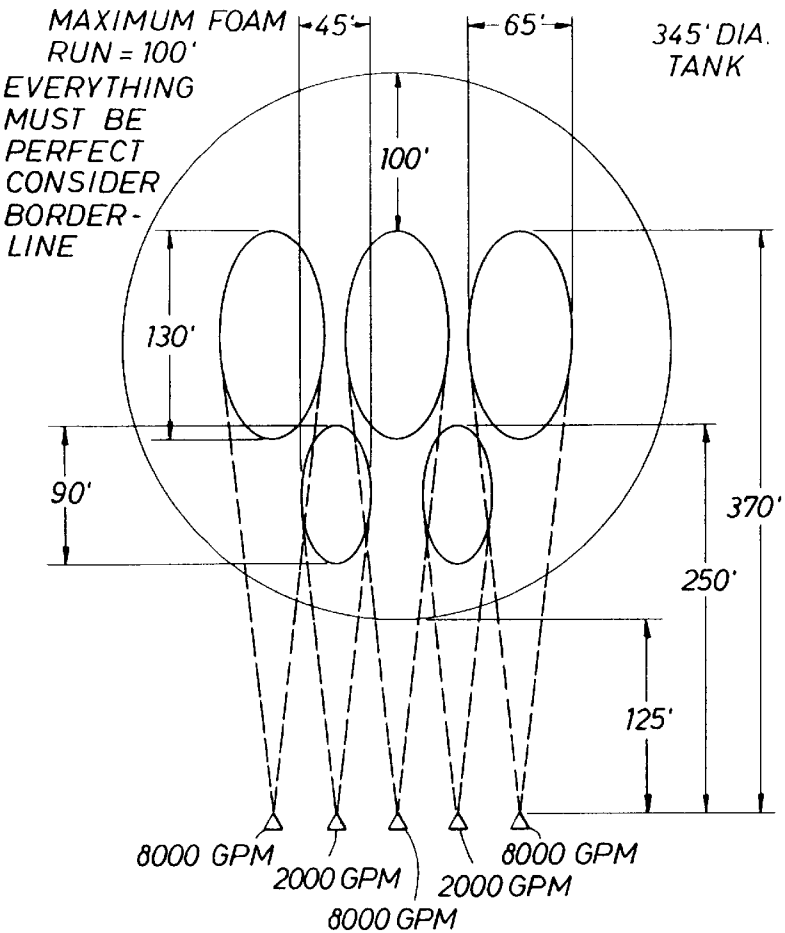

FIGS. 2A through 2T illustrate how such empirical footprint information can be used to stage one or more nozzles from a tank such that predicted footprint and predicted foam run will cover the surface of the fluid in the tank with foam. As foam blanket should be achieved having the requisite density.

Maximum foam run is generally precalculated based upon the type of foam, and the metering or concentration of the foam. The present inventors believe that heretofore not only has foam run for the newer environmental friendly foam concentrates not been calculated, but that variations in foam run caused by the volatility and surface tension of the fluid burning as well as the temperature of the fluid burning have also not been taken into account. Whereas, prior foam has generally been thought to run at least 100 feet, under certain circumstances, such as those mentioned above, the maximum foam run may only be 60 to 70 feet.

Figure 4A:
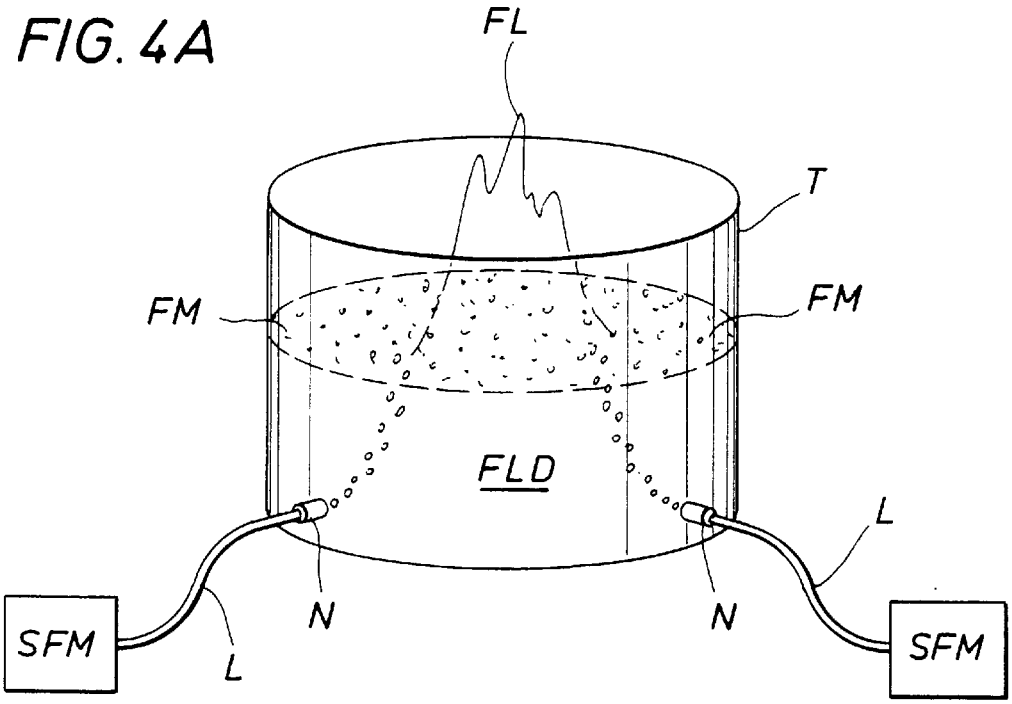
FIG. 4A illustrates a foam attack achieving a foam blanket through bubbling foam up from the bottom of the tank.
Figure 4B:
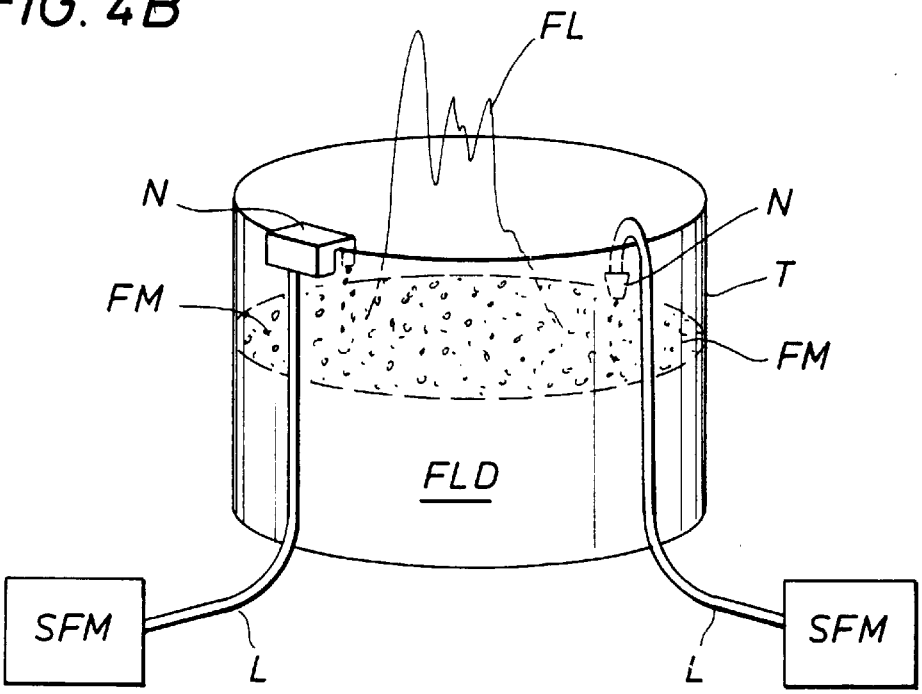
FIG. 4B illustrates a foam attack achieving a foam blanket using either fixed or temporary rim mounted foam nozzles.

FIGS. 4A and 4B illustrate to alternate techniques for mounting a foam attack and achieving and maintaining a foam blanket. FIG. 4A illustrates nozzles attached to tank T. The nozzles are connected by lines L to sources of foam SFM. Foam from nozzles N percolates up through fluid FLD and creates a foam blanket FM on the surface of fluid FLD in tank T. The foam blanket, as it is achieved, should help to at least knock down flames FL.

In FIG. 4B nozzles N are staged on the rim of tank T. The left hand nozzle illustrates a fixed nozzle. The right hand nozzle is drawn to illustrate a temporary wand type nozzle. Foam FM from nozzles N is discharged down the side of the walls of tank T. If such nozzles are staged at appropriate distances around the periphery of the walls of tank T a foam blanket can be achieved over fluid FLD in tank T covering the surface of the fluid in the tank and at least knocking down the flame FL of the burning fluid. Again nozzles N are connected by lines L to sources of foam SFM.

To effectively and expeditiously extinguish MTBE and the like fires, the present invention teaches a system of tank wall cooling, inner and outer, in addition to an improved foam attack, and preferably combining the tank wall cooling with an additional selective dry chemical capability. The system forms a variation on and an improvement of the teaching of the two above referenced pending patent applications, (and incorporated herein by reference.)

In many cases it is anticipated that tank wall cooling will be performed by equipment assembled and staged outside of the tank. Alternately, however, fixed systems can be used to the extent they are in place. The system can be practiced with either fixed or mobile nozzles staged a distance from, or upon, or over, the tank walls.

FIGS. 3A tirough 3C illustrate the technique of outer tank wall cooling. FIG. 3A illustrates the use of nozzles 42 staged approximately 75 feet from the wall of a tank. The nozzles discharge a fluid 43 that is probably water. Preferably, the fluid is discharged at a portion of the outer tank wall at approximately the height of the fluid resident and the tank. LS indicates the liquid surface level in tank T of FIG. 3A. The water illustrated as striking the tank wall at point 40 spreads and cools at least some outer surface portion of the tank wall, preferably in an annular ring around the tank at approximately the level or slightly above the level of the liquid surface LS of the resident fluid in the tank. Nozzles 42 are shown as supplied with their fluid through lines 41.

FIG. 3B illustrates a footprint that could be used to mount a foam attack with nozzles staged distant from tank T. Footprint F is illustrated upon the surface LS of the liquid resident in tank T to be of such dimensions that footprint F together with at least a 90 foot foam run should cover the surface LS of the resident fluid with a foam blanket. Direction 44 illustrates the area of maximum foam run for the footprint. Direction 46 illustrates the area of minimum foam run required for the footprint.

FIG. 3C illustrates mounting both the foam attack and an outer wall cooling attack upon tank T at the same time. In addition, aerial nozzle 54 is illustrated staged over the wall of tank T. In practice, aerial nozzles would be staged on opposite sides of the tank, to the extent possible. Preferably, aerial nozzle 54 would have dry chemical capability. Nozzle 48 is illustrated as discharging foam onto liquid surface LS of the fluid in tank T. Nozzles 42 are illustrated as discharging fluid 43, probably water, onto outer tank walls surfaces of tank T at or about the level of the resident fluid in the tank.

The walls of a tank that have experienced a full surface fire are slow to cool below the boiling point of a low boiling point fluid, such as MTBE (131° F.), or any other similar low boiling point fluid. It has been discovered in particular that the inside surface of a wall will be slow to cool, even after the outside surface of the wall is cooled, and even though the fluid is relatively cool below the surface of the fluid in the tank. (Not far below the surface of a resident fluid, even a surface that is or was recently on fire, fluid temperature can remain relatively cool due to the heat transfer associated with the process of vaporization.)

Since inside the tank the fluid is in thermal communication with tank wall surfaces, the present invention teaches that a specific attack cooling tank wall portion at or about the level of the surface of the resident fluid, and in particular inside tank wall portion in such areas, will significantly reduce the period of time that must otherwise be consumed containing and guarding against vagrant ghost flames from igniting fluid vapors. There is expected to be an equivalent benefit from cooling tank wall surfaces, especially inside surfaces, when the resident fluids have a low auto ignition temperature, again even if such fire can be knocked down relatively quickly.

The outer tank wall can be cooled effectively with water. Although portions of the inner tank wall could be cooled with water, foam is preferable. Water inside a tank sinks below lighter resident fluids. Such presents a risk of the water being raised by a heat wave to its boiling point and bubbling over, carrying with it any flaming contents above. The boiling up of underlying water, expelling burning fluids above, has been known to occur in tanks of burning crude. Since this poses a significant risk, foam forms the preferred cooling medium for inner tank wall surfaces.

Master stream nozzles used for "knock down" of a fire can be utilized to subsequently cool inner tank wall portions, presuming that the tank diameter is such that opposite inside portions of the tank walls lie within the range of the nozzles. Preferably, two aerial nozzles would be staged over the tank walls. These aerial nozzles could apply both foam, useful for inner wall cooling, and selected dry chemicals to attack any small persistent flames at the fluid surface. It has been found that the dry chemical Monex or Purple K works well with ATC foam on MTBE fires, at least in tests on small scale. The present inventors anticipate that Purple K will work well in fires with most blended fuel fluids. Monex has, after several fire tests, proven to be somewhat more effective than Purple K. Monex is Purple K treated with urea. For ships and barges it is known to use cellar nozzles for foam and dry chemicals. A modification of such a cellar nozzle could be configured into a temporary wand to be hung over the side of a tank.

Figure 5A:
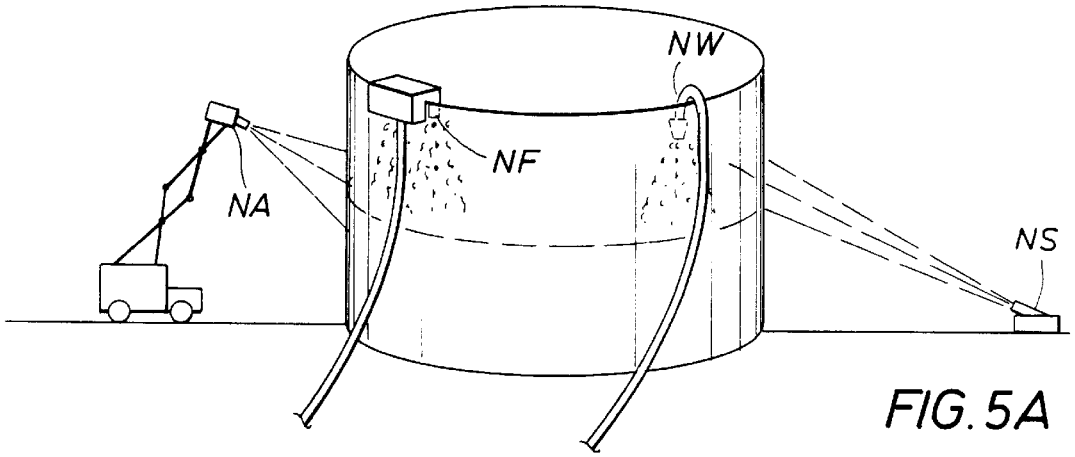
FIG. 5A illustrates outer wall cooling using distantly staged nozzles, permanent and temporary rim mounted nozzles and/or an aerial nozzle.
Figure 5B:
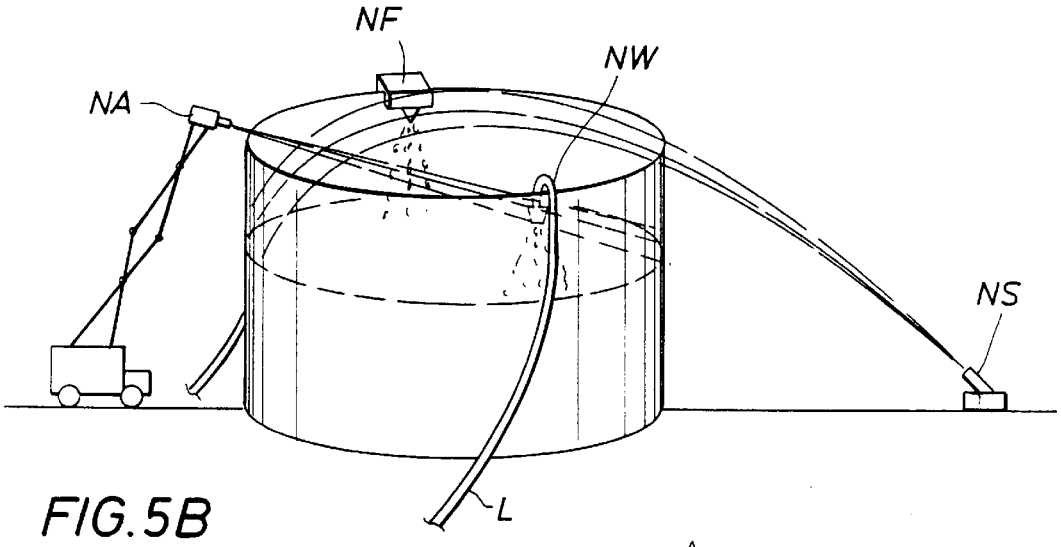
FIG. 5B illustrates inner tank wall rim cooling utilizing a distantly staged nozzle, an aerial nozzle and/or rim mounted nozzles, either permanent or temporary.

FIG. 5A illustrates the use of a distantly staged nozzle NS, a temporary rim mounted nozzle wand NW, a permanently mounted rim nozzles NF and an aerial nozzle NA, all being used to cool portions of the tank wall of tank T. More particularly, the four nozzles are being utilized to cool outside portions of the wall of tank T. Aerial nozzles are particularly effective and should be used mainly on tank fires containing MTBE, octane booster fuels or the like for internal wall cooling. After knock down an aerial nozzle might also be used for a brief time for some outer wall cooling. FIG. 5B illustrates the use of distantly staged nozzle NS, temporarily staged rim nozzle NW, permanently located rim nozzle NF and aerial nozzle NA in order to cool inside portions of the wall of tank T. Nozzle NS is only particularly affective if it can be located such that its range permits it to through foam against the far inside side wall portion of the tank at a height that is approximately the height of the resident fluid in the tank. The fluid of preference to cool inside tank wall portions comprises foam. Aerial nozzle NA is situated most advantageously to cool inside tank wall portions. Rim nozzles can be utilized to cool inside tank wall portions by discharging foam down the inside of the tank wall. It is preferable to cool an annular ring around the inside tank wall at or about the height of the resident fluid. For this reason, a plurality of nozzles should be required to achieve the cooling of the full annular ring with foam.

The present inventors have also determined that the establishment and the maintenance of the proper foam blanket can be critical in extinguishing tank fires. The more difficult the fire to extinguish, the more sensitive the residual fluid, the more critical becomes the establishment and maintenance of a proper foam blanket. Thus, an improved system for foam attack can be important in conserving resources, such as foam, as well as in extinguishing the fire as expeditiously as possible.

To insure the efficient maintenance of a proper foam blanket on the surface of the fluid, the present inventors have discovered that predicted footprint and/or predicted foam run can be effectively adjusted by taking into account one or more of several factors inherent in the actual circumstances. One factor may be the actual variance of the nozzle footprint at the site from a predicted nozzle footprint under the circumstances.

It is advantageous to establish nominal footprints for various nozzles based on nominal conditions, such as nominal wind condition (5 to 10 miles per hour), nominal pressure (100 psi), nominal foam concentrate meterings (3%, 6%, 9%), etc. Such empirically determined nominal footprint information, together with predicted foam run, can be utilized to make a first estimate of the equipment and resources necessary to establish and maintain a successful foam attack. The footprint system has been disclosed in the above referenced pending application.

The present inventors have now discovered that it can be advantageous, at the scene of the fire, to take into account several actual conditions. As mentioned above, it can be advantageous to throw an actual nozzle footprint upon some nearby observable surface adjacent the tank fire. The footprint actually thrown by the nozzle under the selected metering and nozzle stream width. And with the given wind and head pressure, and nozzle stream width, is noted, and several aspects of the footprint might be measured. These aspects include footprint width, footprint length and footprint range (distance from nozzle to toe of footprint). The configuring of the nozzle or nozzles might be adjusted and improved to take into account of significant variations between observed nozzle footprint, under actual conditions, and predicted nozzle footprint and/or predicted foam run.

Figure 6:
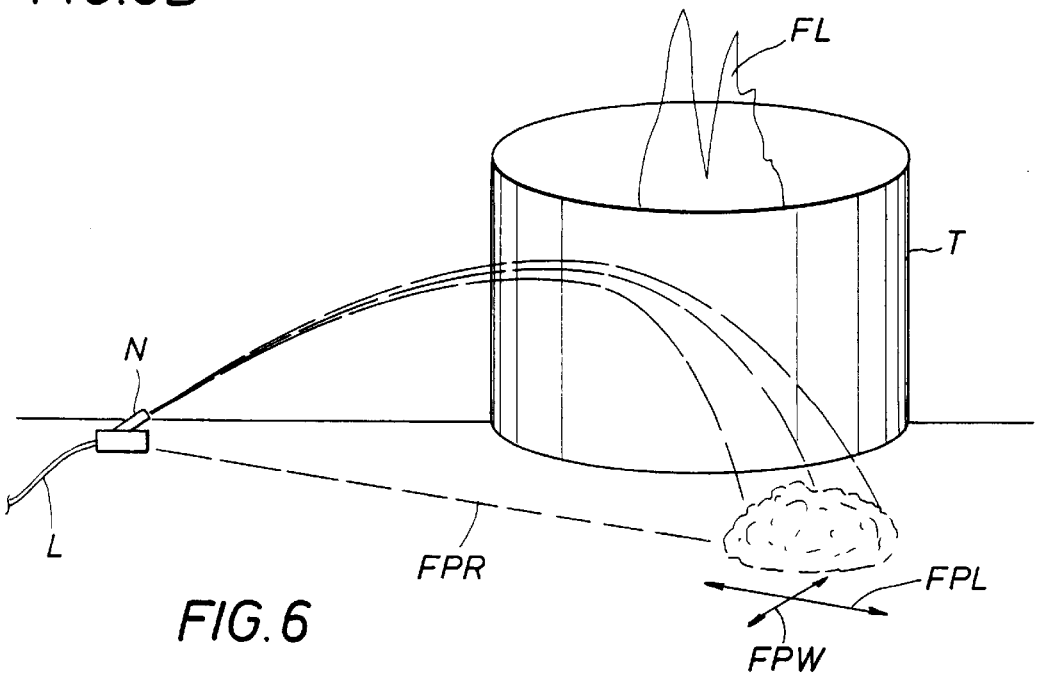
FIG. 6 illustrates throwing a nozzle footprint adjacent the tank on fire.

FIG. 6 illustrates a technique that can be utilized to perfect and improve the foam attack using nozzle staged a distance from the tank. Although, as illustrated in FIGS. 1 and 2, the firefighter preferably has available a predicted footprint for given nozzle under nominal conditions, variations of the actual footprint to be thrown by a given nozzle under actual firefighting conditions may be important. For that reason, the present inventors teach throwing an actual footprint away from or outside of the fire, preferably on an area just adjacent the tank, in order to keep wind conditions more or less constant. Various aspects of this footprint can be noted, including its range, the footprint length and the footprint width. Staging or configuring the nozzles then to be used to fight the fire can be adjusted to take into account variations of the actual footprint from the predicted footprint. FIG. 6 illustrates nozzle N, supplied with foam by line L, throwing a footprint adjacent tank T, tank T being engulfed with flames FL. The footprint has footprint range FPR, footprint length FPL and footprint width FPW.

Foam attacks for extinguishing a tank fire are frequently mounted using nozzles staged outside of and peripheral to the tank on fire. Such type of foam attack are discussed in the above-referenced pending patent applications. The attack may include empirically determining the footprint for a nozzle and configuring one or more nozzles such that predicted footprint and predicted foam run cover a tank fluid's surface.

Several additional factors can be taken into account, and in certain circumstances should be taken into account, in order to perfect and enhance the efficiency of the foam attack. It is important to blanket the full surface of the fluid in the tank. However, at the same time it is important to efficiently utilize resources, including in particular the expensive resource of foam.

It is one aspect of the present invention that the type of fluid burning, and in particular the fluid volatility and/or surface tension, affects foam run. When the surface tension of the burning fluid is low, for instance, it is has been discovered that the fluid does not support a significant run of film from the foam. Film from the foam can be quite helpful in extinguishing tank fires. When the film is not supported by the surface tension of the fluid, the fire must be extinguished by the bubbles of the foam. Foam bubbles do not run as far as foam film.

Furthermore, it has been discovered that the volatility of the fluid on fire can effect the capacity of a foam to run. Reasons can be proposed for this effect, although the process is probably complex.

Figure 7A:
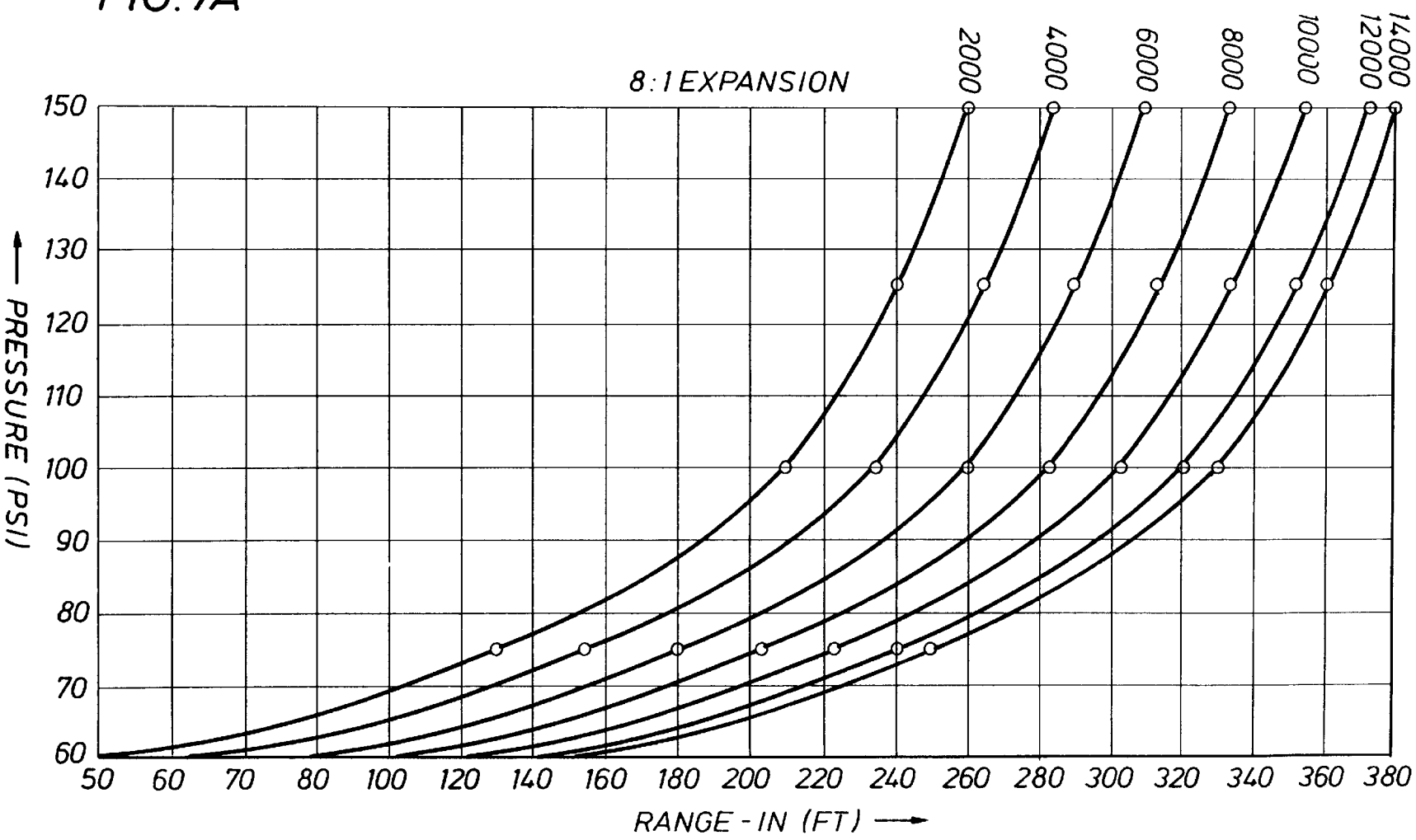
FIGS. 7A and 7B are tables showing a variation in range of a nozzle of a given size and for a given expansion, based on variations in water pressure.
Figure 7B:
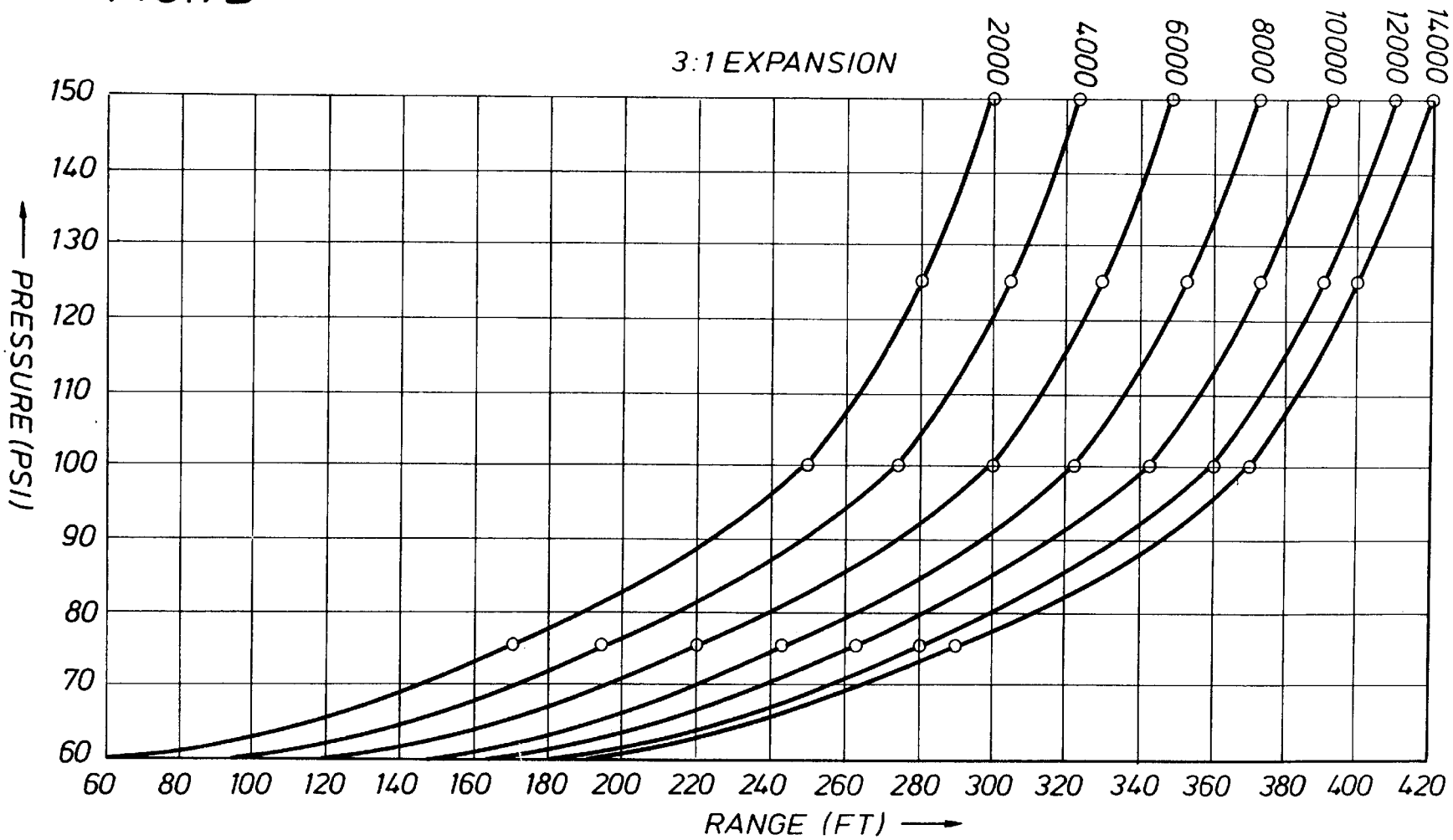

The level of concentration, or the selected metering, of the foam used (usually between standard metering percents of 3%, 6% and/or 9%) can also affect foam run. In general, the greater the percent or concentration of foam, the slower the foam to run. However, the type of foam also enters into the calculations. Never, more environmentally friendly compositions have been found to run at 6% concentration much like older foam compositions ran at 3%. It is advantageous to have experimented with, and be advised by precalculations, of the capacity of different types of foam to run when utilized in different percent concentrations. Furthermore, the same foam that should run up to 100 feet on crude or gasoline, may only run 60 to 70 feet on an MTBE fire. Footprint range, footprint length and footprint width can be affected by the water pressure or head pressure, by wind conditions and by the stream width. FIGS. 7-A and 7-B illustrate the change in footprint range, (that is the distance from the nozzle to the footprint toe furthest away from the nozzle) for different nozzles as water pressure, measured in pounds per square inch, varies. 100 psi comprises nominal pressure. Footprint calculations may be made assuming that a nozzle will be supplied with 100 psi. In point of fact, under actual conditions, the head pressure or psi of water supplied may vary by 25 psi or so either way around the nominal 100 psi. FIGS. 7-A and 7-B, calculated for two different foam expansion ratios, illustrate how for nozzles with a gpm volume of from 2,000 gpm to 14,000 gpm vary their range depending upon variations in pressure. Experience has shown that pressure affects not only footprint range but also footprint length and to a small extent footprint width. The greater the pressure not only the greater the range but also the greater the footprint length. Footprint width also expands to a small extent with increased pressure. Concomitantly, as pressure decreases, range decreases, footprint length decreases and, to a small extent, so does footprint width.

Nozzles for extinguishing a tank fire are, for at least a variety of reasons, staged upwind of the fire. Most calculations assume a nominal wind of 5 to 10 miles per hour. Experience has shown, however, that with winds of 20 mph or greater range calculations should generally be increased by approximately 10%. Winds of 20 mph or greater also lengthen the footprint somewhat, experience has shown. The footprint width should be anticipated to narrow to some extent with winds greater than 20 mph.

Most fire fighting nozzles used for extinguishing tank fires contain an adjustable sleeve that slides over the main barrel of the nozzle. When the sleeve is in its full extended position, the nozzle is directed to throw its most narrow and focused stream. When the sleeve is in its most contracted position with respect to the basic nozzle barrel, the nozzle is set to throw its broadest, most fog-like pattern. Generally, fog patterns are used to protect personnel and equipment. The optimum stream width for a fire fighting nozzle attempting to throw a maximum distance a suitable footprint of foam a maximum distance is what is referred to as the "straight stream" pattern. The straight stream pattern appears tube-like emerging from the nozzle. It does not spread immediately into a fog pattern. Alternately, it does not exhibit a focused or hour-glass type shape, narrowing to a focal point slightly downstream of the nozzle. A straight stream is the preferred throw pattern because it is believed to maximize the reach of the nozzle and the nozzle's foam quality, enhancing foam expansion and drainage qualities.

Notwithstanding the above, the sleeve setting and thus the stream width may be altered from the straight stream pattern under certain circumstances in fighting a fire. For instance, the setting of the sleeve, and thus the stream width, has somewhat of an effect upon the expansion of the foam. To achieve a slightly different expansion the sleeve and the stream width might be altered. Also, the stream width affects range. The sleeve width might be altered to intentionally reduce range. When the stream width is widened, range is reduced, the footprint length is reduced and the footprint width is increased.

Foam expansion is determined by the aeration of the nozzle. Some nozzles permit settings that vary the aeration. Other nozzles are built to achieve a particular aeration ratio. Aeration affects foam expansion. FIGS. 7-A and 7-B show the variation in range with water pressure for a variety of nozzles at two different expansion ratios. It can be seen that the low 3.1 expansion results in significantly greater range for the nozzle. In most circumstances, thus a lower expansion such as a three-to-one expansion is desired.

In operation, a foam attack is designed and carried out using the best available equipment and facilities. The foam blanket may be established using fixed rim nozzles, temporary rim nozzles, staged distant nozzles and/or any aerial nozzles that may be brought to bear over the rim of the tank. Assuming that one or more staged distant nozzles will be used, the firefighter is best provided with predicted footprints for that nozzle size at least under nominal conditions. Based upon such information the firefighter configures one or more nozzles such that predicted footprint and predicted foam run will achieve the requisite foam blanket over the surface of the liquid in the tank.

If possible, the firefighter throws a sample footprint adjacent the tank away from the fire. Variations in range length and/or width of such footprint from the predicted footprint are noted. The configuring of the one or more nozzles should then adjusted accordingly to take into account variations of predicted footprint under actual conditions. For instance, range can be varied by varying the inclination of the nozzle stream. Range can be shortened by increasing stream width through use of an adjustable sleeve on the nozzle. Foam run can be recalculated based upon the foam being utilized, the selected metering or concentration of foam, as well as the actual fluid on fire including its volatility and surface tension, as well as its estimated temperature of burning.

One or two aerial nozzles will be staged over the rim of the tank if possible, providing at least dry chemical capability. Preferably, the nozzles provide both foam and dry chemical capability.

After a foam blanket has been established outer and/or inner tank wall cooling may be commenced. For low boiling point and/or low auto ignition fires, inner rim cooling with foam is preferred. The rim cooling must be provided by whatever nozzles are available.

Outer rim cooling may also be provided or may alternately be provided. Outer rim cooling is usually accomplished using water. Tank wall cooling is preferably performed at or about the level of the resident fluid in the tank.

Configuring of staged nozzles for a foam attack can also be varied depending upon actual footprint and the actual foam run expected taking into account various actual factors. Actual footprint can be more closely predicted based on variations of water pressure from nominal as well as variations in the selected metering of the foam, the type of foam and the stream width selected. Estimations of foam run can be adjusted in accordance with the type of fluid burning, and in particular its volatility and surface tension, as well as its temperature of burning. The particular type of foam and its concentration will also be a factor in estimating actual foam run.

The foregoing disclosure and description of the invention are illustrative and explanatory thereof, and various changes in the size, shape, and materials, as well as in the details of the illustrated system may be made without departing from the spirit of the invention.

What is claimed is:

1. A method for extinguishing tank fires of low boiling point and/or low auto-ignition point fluids comprising:

delivering foam to a fluid surface in a tank by at least one of the steps of throwing foam from a nozzle remote from the tank and bubbling foam up through the fluid in the tank;

establishing a foam blanket to substantially cover the fluid surface in the tank; and subsequently applying fluid to inner tank wall portions for cooling tank wall portions.

2. The method of claim 1 that includes cooling inner tank wall portions by applying foam.

3. The method of claim 2 wherein the inner tank wall portions are cooled at approximately the height of the fluid in the tank.

4. The method of claim 2 wherein the cooling includes cooling inner tank wall portions that comprise an annular ring around the tank.

5. The method of claim 1 that includes cooling outer tank wall portions by application of fluid to outer tank wall surface.

6. The method of claim 1 wherein the covering includes positioning one or more foam applying nozzles around the tank such that one or more nozzle footprints together with foam run cover the tank liquid surface.

7. The method of claim 1 wherein the covering includes stationing a foam nozzle upon a side wall of a tank.

8. The method of claim 1 that includes selectively applying dry powder to flames in the tank.

9. The method of claim 8 wherein the selective applying is subsequent to substantially covering the tank fluid surface with foam.

10. The method of claim 8 wherein the applying dry powder includes positioning a dry powder nozzle over a tank wall.

11. The method of claim 1 that includes applying fluid to inner tank wall portions using a portable discharge unit.

12. A method for extinguishing tank fires of low boiling point and/or low auto-ignition point fluids comprising:

delivering foam to a fluid surface in a tank by at least one of the steps of throwing foam from a nozzle remote from the tank and bubbling foam up through the fluid in the tank;

covering the fluid surface in the tank with foam;

applying fluid to inner tank wall portions for cooling tank wall portions; and cooling outer tank wall portions at approximately the height of the fluid in the tank by application of fluid to outer tank wall surface.

13. A method for extinguishing tank fires of low boiling point and/or low auto-ignition point fluids comprising:

delivering foam to a fluid surface in a tank by at least one of one of the steps of throwing foam from a nozzle remote from the tank and bubbling foam up through the fluid in the tank;

establishing a foam blanket to substantially cover the fluid surface in the tank; and applying fluid to inner tank wall portions above the foam level in the tank for cooling tank wall portions.

14. The method of claim 13 that includes applying fluid to inner tank wall portions using a portable discharge unit.

15. A method for extinguishing tank fires of low boiling point and/or low auto-ignition point fluids comprising:

delivering foam to a fluid surface in a tank by at least one of the steps of throwing foam from a nozzle remote from the tank and bubbling foam up through the fluid in the tank;

establishing a foam blanket to substantially cover the fluid surface in the tank; and discharging fluid upon inner tank wall portions from an orifice located outside of the foam blanket, for cooling the wall portions.

16. The method of claim 15 that includes applying fluid to inner tank wall portions using a portable discharge unit.

17. A method for extinguishing tank fires of low boiling point and/or low auto-ignition point fluids comprising:

covering a fluid surface in a tank with foam; and cooling tank wall portions wherein the cooling is begun after the covering is substantially complete.

18. In a foam attack system for extinguishing a tank fire that includes empirically determining a footprint for a nozzle and configuring one or more nozzles such that predicted footprint and predicted foam run cover a tank fluid surface, an improvement comprising:

creating a footprint of foam at the site and outside of the actual tank fire with a nozzle to be utilized in extinguishing the fire.

19. The method of claim 18 that includes:

measuring at least one aspect of the created footprint; and taking into account the aspect when configuring the one or more nozzles.

20. The method of claim 18 that includes adjusting at least one of predicted footprint and predicted foam run to take into account at least one of the factors consisting of wind conditions, nozzle stream width, head pressure, percent of foam concentrate, actual burning fluid, actual type of foam and temperature of burning fluid.

21. The method of claim 20 that includes precalculating variations of at least one of footprint range, footprint width, footprint length and foam run based upon a variation of at least one of said factors.

22. The method of claim 21 wherein variations in footprint range are precalculated based on variations in pressure.

23. The method of claim 21 wherein variations in foam run are precalculated on variations in at least one of foam type, percent concentration of foam and type of fluid burning.

24. A method for extinguishing tank fires of low boiling point and/or low auto-ignition point fluids comprising:

covering a fluid surface in a tank with foam;

cooling tank wall portions wherein the cooling is begun after the covering is substantially complete; and cooling inner tank wall portions with foam.

* * * * *